US010054376B2

(12) United States Patent
Higashiiue et al.

(10) Patent No.: US 10,054,376 B2
(45) Date of Patent: Aug. 21, 2018

(54) HEAT EXCHANGER AND AIR-CONDITIONING APPARATUS

(71) Applicant: Mitsubishi Electric Corporation, Tokyo (JP)

(72) Inventors: Shinya Higashiiue, Tokyo (JP); Akira Ishibashi, Tokyo (JP); Takashi Okazaki, Tokyo (JP); Daisuke Ito, Tokyo (JP); Shigeyoshi Matsui, Tokyo (JP); Yuki Ugajin, Tokyo (JP); Norihiro Yoneda, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 280 days.

(21) Appl. No.: 15/027,259

(22) PCT Filed: Oct. 29, 2013

(86) PCT No.: PCT/JP2013/079247

§ 371 (c)(1),
(2) Date: Apr. 5, 2016

(87) PCT Pub. No.: WO2015/063857

PCT Pub. Date: May 7, 2015

(65) Prior Publication Data

US 2016/0245596 A1 Aug. 25, 2016

(51) Int. Cl.
*F28D 7/06* (2006.01)
*F28F 9/02* (2006.01)
(Continued)

(52) U.S. Cl.
CPC ..... *F28F 9/026* (2013.01); *F25B 39/00* (2013.01); *F28D 1/024* (2013.01); *F28D 1/0426* (2013.01);
(Continued)

(58) Field of Classification Search
CPC ..... F28F 9/026; F28F 9/0278; F28F 1/025; F28F 9/0221; F28D 1/024; F28D 1/0476;
(Continued)

(56) References Cited

U.S. PATENT DOCUMENTS 4,023,618 A * 5/1977 Kun ..... F28D 9/00 165/148
5,242,016 A * 9/1993 Voss ..... F25B 39/028 165/173
(Continued)

FOREIGN PATENT DOCUMENTS

EP 0634615 A1 1/1995
JP 63-80465 U 5/1988
(Continued)

OTHER PUBLICATIONS

Office Action dated Jul. 24, 2017 issued in corresponding CN patent application No. 2013800806100 (and English translation).
(Continued)

*Primary Examiner* — Claire Rojohn, III
(74) *Attorney, Agent, or Firm* — Posz Law Group, PLC

(57) ABSTRACT

A heat exchanger according to the present invention includes a heat exchanging unit, and a distributing and joining unit connected to the heat exchanging unit and including a distributing flow passage and a joining flow passage. The distributing and joining unit separately includes a first header including the distributing flow passage formed therein and excluding the joining flow passage, and a second header juxtaposed to the first header and including the joining flow passage formed therein and excluding the distributing flow passage. At least one of the first header and the second header is a stacking type header including a plurality of plate-like members including partial flow passages formed therein and stacked so that the partial flow
(Continued)

passages are communicated with each other to form the distributing flow passage or the joining flow passage.

12 Claims, 14 Drawing Sheets

(51) Int. Cl.

| | |
|---|---|
| ***F25B 39/00*** | (2006.01) |
| ***F28D 1/04*** | (2006.01) |
| ***F28D 1/047*** | (2006.01) |
| ***F28F 1/02*** | (2006.01) |
| ***F28D 1/02*** | (2006.01) |
| *F25B 13/00* | (2006.01) |

(52) U.S. Cl.
CPC ..... *F28D 1/0476* (2013.01); *F28F 1/025* (2013.01); *F28F 9/0221* (2013.01); *F28F 9/0278* (2013.01); *F25B 13/00* (2013.01); *F25B 2313/0253* (2013.01)

(58) Field of Classification Search
CPC ..... F28D 1/0426; F25B 39/00; F25B 13/00; F25B 2313/0253
See application file for complete search history.

(56) References Cited

U.S. PATENT DOCUMENTS 5,479,985 A * 1/1996 Yamamoto ..... F28D 1/05391 165/153
5,720,341 A * 2/1998 Watanabe ..... F28D 1/024 165/135
7,044,208 B2 * 5/2006 Kawakubo ..... F28D 1/05375 165/173
8,726,976 B2 * 5/2014 Schrader ..... F28D 1/0426 165/140
8,783,057 B2 * 7/2014 Nelson ..... F25B 39/028 165/110
9,651,317 B2 * 5/2017 Jindou ..... F28F 9/02
2003/0070792 A1 * 4/2003 Tanaka ..... F28D 15/0233 165/104.21
2003/0150599 A1 * 8/2003 Suzuki ..... F28D 15/0266 165/104.21
2005/0103486 A1 * 5/2005 Demuth ..... F28D 1/0478 165/174
2005/0235691 A1 * 10/2005 Katoh ..... F25B 39/02 62/515
2005/0284621 A1 * 12/2005 Katoh ..... F28D 1/05391 165/174
2008/0053137 A1 * 3/2008 Higashiyama ..... B60H 1/00335 62/324.6
2010/0083694 A1 * 4/2010 Takagi ..... F25B 39/022 62/515
2010/0319894 A1 * 12/2010 Biver ..... F25B 39/028 165/173
2014/0305159 A1 * 10/2014 Katoh ..... F28D 7/0008 62/515
2016/0076823 A1 * 3/2016 Okazaki ..... F28F 9/028 165/174
2016/0076824 A1 * 3/2016 Matsuda ..... F28F 9/0221 165/174
2016/0076825 A1 * 3/2016 Matsuda ..... F28F 9/0278 165/148
2016/0116231 A1 * 4/2016 Higashiiue ..... F28F 9/02 165/174
2016/0169595 A1 * 6/2016 Matsuda ..... F28F 9/0221 165/104.21
2016/0202000 A1 * 7/2016 Higashiiue ..... F28F 9/0278 165/104.21
2016/0223272 A1 * 8/2016 Nakamura ..... F28F 9/0221
2016/0245560 A1 * 8/2016 Higashiiue ..... F28F 9/0246
2016/0245596 A1 * 8/2016 Higashiiue ..... F25B 39/00
2017/0241684 A1 * 8/2017 Ito ..... F25B 39/00
2017/0328638 A1 * 11/2017 Wu ..... F28D 1/05383
2017/0328652 A1 * 11/2017 Matsui ..... F28F 9/0268
2017/0336145 A1 * 11/2017 Nakamura ..... F28D 1/047
2018/0073820 A1 * 3/2018 Higashiiue ..... F28F 9/0278

FOREIGN PATENT DOCUMENTS

JP 06-011291 A 1/1994
JP 09-189463 A 7/1997
JP 10-267468 A 10/1998
JP 2000-161818 A 6/2000
JP 3444750 B2 6/2003
JP 2003-287390 A 10/2003
JP 2008-286488 A 11/2008
JP 2012-032089 A 2/2012
JP 2013-120039 A 6/2013
WO 2004/025207 A1 3/2004
WO 2007/063978 A1 6/2007

OTHER PUBLICATIONS

Extended European Search Report dated Jun. 13, 2017 issued in corresponding EP patent application No. 13896696.5.
Office Action dated Apr. 1, 2017 issued in corresponding CN patent application No. 201380080610.0 (and English translation).
Office Action dated Aug. 9, 2016 issued in corresponding JP patent application No. 2015-544657 (and English translation).
International Search Report of the International Searching Authority dated Jan. 21, 2014 for the corresponding international application No. PCT/JP2013/079247 (and English translation).
Office Action dated May 23, 2018 in corresponding European Patent Application No. 13 896 696.5.

* cited by examiner

HEAT EXCHANGER AND AIR-CONDITIONING APPARATUS

CROSS REFERENCE TO RELATED APPLICATION

This application is a U.S. national stage application of International Application No. PCT/JP2013/079247, filed on Oct. 29, 2013, the contents of which are incorporated herein by reference.

TECHNICAL FIELD

The present invention relates to a heat exchanger and an air-conditioning apparatus.

BACKGROUND

As a related-art heat exchanger, there is known a heat exchanger including a heat exchanging unit including a plurality of stages of refrigerant flow passages allowing refrigerant to flow in from end portions on one side thereof and flow out of end portions on the other side thereof that are juxtaposed to the end portions on the one side, and a distributing and joining unit connected to the heat exchanging unit and including a distributing flow passage allowing the refrigerant to be distributed and flow out, and a joining flow passage allowing the refrigerant to be joined and flow out (for example, see Patent Literature 1).

PATENT LITERATURE

Patent Literature 1: Japanese Unexamined Patent Application Publication No. 2000-161818 (paragraph [0032] to paragraph [0036], FIG. 7, and FIG. 8)

In such a heat exchanger, the distributing flow passage and the joining flow passage of the distributing and joining unit are formed in a single header. Thus, for example, when the heat exchanger acts as an evaporator so that refrigerant in a two-phase gas-liquid state flows into the heat exchanger and refrigerant in a superheated gas state flows out of the heat exchanger, low-temperature refrigerant passes through the distributing flow passage of the header, whereas high-temperature refrigerant passes through the joining flow passage of the header. As a result, heat is exchanged due to a temperature difference between the low-temperature refrigerant and the high-temperature refrigerant. Further, when the heat exchanger acts as a condenser so that refrigerant in a superheated gas state flows into the heat exchanger and refrigerant in a subcooled liquid state flows out of the heat exchanger, high-temperature refrigerant passes through the distributing flow passage of the header, whereas low-temperature refrigerant passes through the joining flow passage of the header. As a result, heat is exchanged due to a temperature difference between the high-temperature refrigerant and the low-temperature refrigerant. In other words, such a heat exchanger has a problem in that the heat exchange efficiency is low.

SUMMARY

The present invention has been made in view of the problem as described above, and thus has an object to provide a heat exchanger enhanced in heat exchange efficiency. Further, the present invention has an object to provide an air-conditioning apparatus including the heat exchanger as described above.

A heat exchanger according to the present invention includes a heat exchanging unit including a plurality of stages of refrigerant flow passages each allowing refrigerant to flow in from an end portion on one side of each of the refrigerant flow passages, turn back at a first turn-back portion, and flow out of an end portion on an other side juxtaposed to the end portion on the one side, and a distributing and joining unit connected to the heat exchanging unit, the distributing and joining unit including a distributing flow passage allowing the refrigerant to be distributed and flow into a plurality of the end portions on the one side, and a joining flow passage allowing the refrigerant to be joined and flow out of a plurality of the end portions on the other side. The distributing and joining unit separately includes a first header including the distributing flow passage formed therein and excluding the joining flow passage, and a second header juxtaposed to the first header, the second header including the joining flow passage formed therein and excluding the distributing flow passage. At least one of the first header and the second header includes a stacking type header including a plurality of plate-like members including partial flow passages formed therein and stacked to each other so that the partial flow passages are communicated with each other to form the distributing flow passage or the joining flow passage.

In the exchanger according to the present invention, the distributing and joining unit separately includes the first header including the distributing flow passage formed therein and excluding the joining flow passage, and the second header juxtaposed to the first header and including the joining flow passage formed therein and excluding the distributing flow passage. The at least one of the first header and the second header is the stacking type header. Thus, the heat exchange between the refrigerant passing through the distributing flow passage and the refrigerant passing through the joining flow passage is controlled, and the refrigerant passing through the distributing flow passage or the joining flow passage is heated or cooled. As a result, the heat exchange efficiency is enhanced.

DETAILED DESCRIPTION

Figure 1:
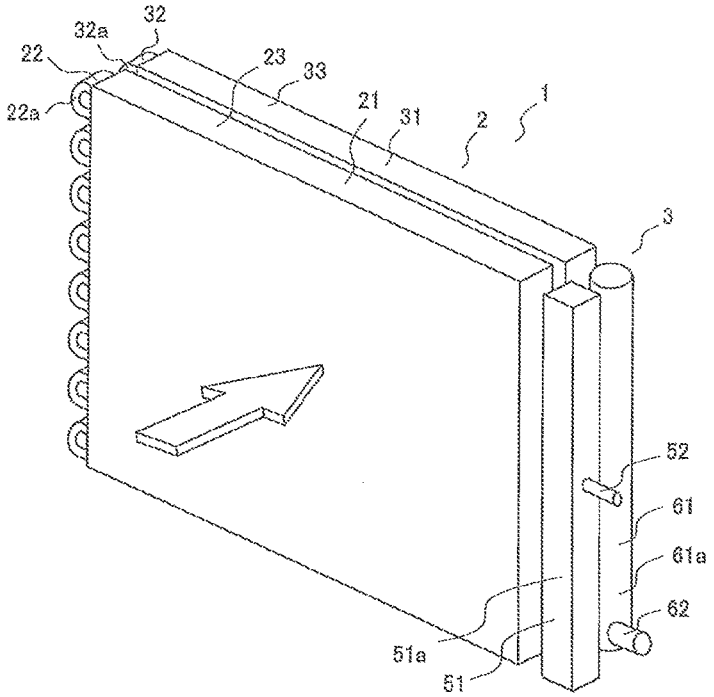
FIG. 1 is a perspective view of a heat exchanger according to Embodiment 1.

A heat exchanger according to the present invention is described below with reference to the drawings.

Note that, the configuration, operation, and other matters described below are merely examples, and the heat exchanger according to the present invention is not limited to such configuration, operation, and other matters. Further, in the drawings, the same or similar components are denoted by the same reference signs, or the reference signs therefor are omitted. Further, the illustration of details in the structure is appropriately simplified or omitted. Further, overlapping description or similar description is appropriately simplified or omitted.

Further, in the following, there is described a case where the heat exchanger according to the present invention is applied to an air-conditioning apparatus, but the present invention is not limited to such a case, and for example, the heat exchanger according to the present invention may be applied to other refrigeration cycle apparatus including a refrigerant circuit. Still further, there is described a case where the heat exchanger according to the present invention is an outdoor heat exchanger of the air-conditioning apparatus, but the present invention is not limited to such a case, and the heat exchanger according to the present invention may be an indoor heat exchanger of the air-conditioning apparatus. Still further, there is described a case where the air-conditioning apparatus switches between a heating operation and a cooling operation, but the present invention is not limited to such a case, and the air-conditioning apparatus may perform only the heating operation or the cooling operation.

Embodiment 1

A heat exchanger according to Embodiment 1 is described.

<Configuration of Heat Exchanger>

The configuration of the heat exchanger according to Embodiment 1 is described below.

(Schematic Configuration of Heat Exchanger)

The schematic configuration of the heat exchanger according to Embodiment 1 is described below.

FIG. 1 is a perspective view of the heat exchanger according to Embodiment 1.

As illustrated in FIG. 1, a heat exchanger 1 includes a heat exchanging unit 2 and a distributing and joining unit 3. The heat exchanging unit 2 corresponds to a "heat exchanging unit" of the present invention.

The heat exchanging unit 2 includes a windward heat exchanging unit 21 arranged on a windward side in a passing direction of air passing through the heat exchanging unit 2 (white arrow in FIG. 1), and a leeward heat exchanging unit 31 arranged on a leeward side in the air passing direction. The windward heat exchanging unit 21 includes a plurality of windward heat transfer tubes 22 and a plurality of windward fins 23 joined to the plurality of windward heat transfer tubes 22 by, for example, brazing. The leeward heat exchanging unit 31 includes a plurality of leeward heat transfer tubes 32 and a plurality of leeward fins 33 joined to the plurality of leeward heat transfer tubes 32 by, for example, brazing. The heat exchanging unit 2 may be constructed of two rows including the windward heat exchanging unit 21 and the leeward heat exchanging unit 31, or may be constructed of three or more rows.

Each of the windward heat transfer tube 22 and the leeward heat transfer tube 32 is a flat tube, and a plurality of flow passages are formed inside the flat tube. Each of the plurality of windward heat transfer tubes 22 and each of the plurality of leeward heat transfer tubes 32 are bent into a hair-pin shape at portions between end portions on one side and end portions on the other side so that turn-back portions 22*a* and 32*a* are formed, respectively. The windward heat transfer tubes 22 and the leeward heat transfer tubes 32 are arranged in a plurality of stages in a direction intersecting with the passing direction of the air passing through the heat exchanging unit 2 (white arrow in FIG. 1). The end portions on the one side and the end portions on the other side of each of the plurality of windward heat transfer tubes 22 and each of the plurality of leeward heat transfer tubes 32 are juxtaposed to be opposed to the distributing and joining unit 3. Each of the windward heat transfer tube 22 and the leeward heat transfer tube 32 may be a circular tube (for example, a circular tube having a diameter of 4 mm). Each of the plurality of flow passages formed in the flat tube or a flow passage formed in the circular tube corresponds to a "refrigerant flow passage" of the present invention. The turn-back portion 22*a* corresponds to a "first turn-back portion" of the present invention. The turn-back portion 32*a* corresponds to a "third turn-back portion" of the present invention.

Instead of the configuration in which the windward heat transfer tube 22 and the leeward heat transfer tube 32 are bent into a hair-pin shape at the portions between the end portions on the one side and the end portions on the other side so that the turn-back portions 22*a* and 32*a* are formed, respectively, the end portion on the one side of each of the windward heat transfer tube 22 and the leeward heat transfer tube 32 and the end portion on the one side of each of the windward heat transfer tube 22 and the leeward heat transfer tube 32 in a stage above or below a stage of the above-mentioned ends may be connected to each other through a coupling member including a flow passage formed therein so that the refrigerant is turned back. In such a case, the flow passage formed in the coupling member corresponds to the "first turn-back portion" or the "third turn-back portion" of the present invention.

The distributing and joining unit 3 includes a stacking type header 51 and a tubular header 61. The stacking type header 51 and the tubular header 61 are juxtaposed along the passing direction of the air passing through the heat exchanging unit 2 (white arrow in FIG. 1). A refrigerant pipe (not shown) is connected to the stacking type header 51 through a connection pipe 52. A refrigerant pipe (not shown) is connected to the tubular header 61 through a connection pipe 62. Each of the connection pipe 52 and the connection pipe 62 is, for example, a circular pipe.

The stacking type header 51 is connected to the windward heat exchanging unit 21, and a distributing and joining flow passage 51*a* is formed inside the stacking type header 51. When the heat exchanging unit 2 acts as an evaporator, the distributing and joining flow passage 51*a* serves as a distributing flow passage allowing refrigerant flowing in from the refrigerant pipe (not shown) to be distributed and flow out to the plurality of windward heat transfer tubes 22 of the windward heat exchanging unit 21. When the heat exchanging unit 2 acts as a condenser, the distributing and joining flow passage 51*a* serves as a joining flow passage allowing refrigerant flowing in from the plurality of windward heat transfer tubes 22 of the windward heat exchanging unit 21 to be joined and flow out to the refrigerant pipe (not shown).

The tubular header 61 is connected to the leeward heat exchanging unit 31, and a distributing and joining flow passage 61*a* is formed inside the tubular header 61. When the heat exchanging unit 2 acts as a condenser, the distributing and joining flow passage 61*a* serves as a distributing flow passage allowing refrigerant flowing in from the refrigerant pipe (not shown) to be distributed and flow out to the plurality of leeward heat transfer tubes 32 of the leeward heat exchanging unit 31. When the heat exchanging unit 2 acts as an evaporator, the distributing and joining flow passage 61*a* serves as a joining flow passage allowing refrigerant flowing in from the plurality of leeward heat transfer tubes 32 of the leeward heat exchanging unit 31 to be joined and flow out to the refrigerant pipe (not shown).

That is, when the heat exchanging unit 2 acts as an evaporator, the heat exchanger 1 separately includes the stacking type header 51 including the distributing flow passage (distributing and joining flow passage 51*a*) formed therein and excluding the joining flow passage (distributing and joining flow passage 61*a*), and the tubular header 61 including the joining flow passage (distributing and joining flow passage 61*a*) formed therein and excluding the distributing flow passage (distributing and joining flow passage 51*a*). In such a case, the stacking type header 51 corresponds to a "first header" of the present invention, whereas the tubular header 61 corresponds to a "second header" of the present invention.

Further, when the heat exchanging unit 2 acts as a condenser, the heat exchanger 1 separately includes the tubular header 61 including the distributing flow passage (distributing and joining flow passage 61*a*) formed therein and excluding the joining flow passage (distributing and joining flow passage 51*a*), and the stacking type header 51 including the joining flow passage (distributing and joining flow passage 51*a*) formed therein and excluding the distributing flow passage (distributing and joining flow passage 61*a*). In such a case, the tubular header 61 corresponds to the "first header" of the present invention, whereas the stacking type header 51 corresponds to the "second header" of the present invention.

(Configuration of Stacking Type Header)

The configuration of the stacking type header of the heat exchanger according to Embodiment 1 is described below.

Figure 2:
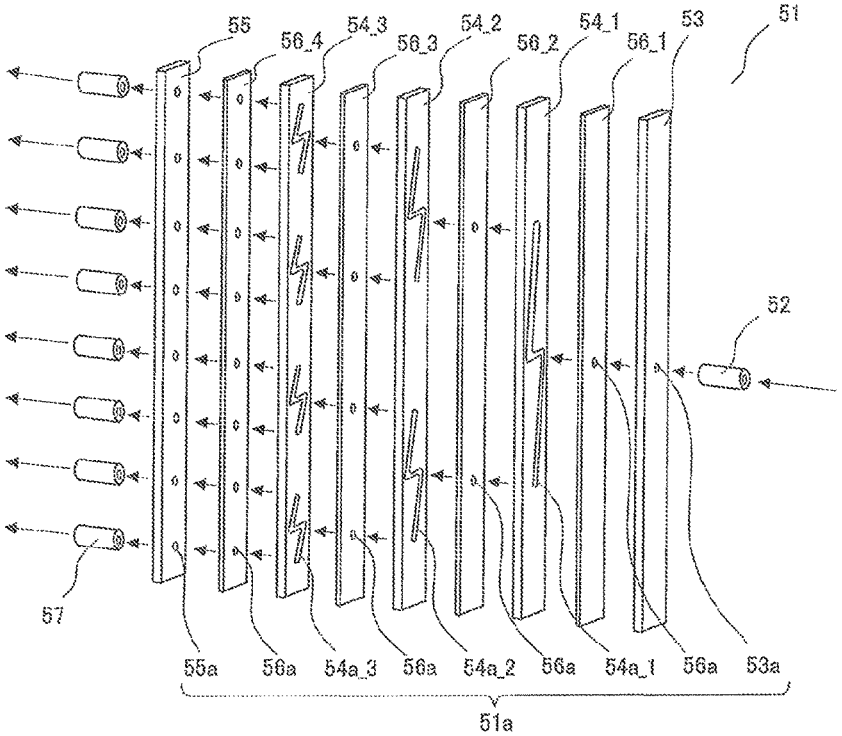
FIG. 2 is a perspective view of the heat exchanger according to Embodiment 1 under a state in which a stacking type header is disassembled.

FIG. 2 is a perspective view of the heat exchanger according to Embodiment 1 under a state in which the stacking type header is disassembled. Note that, in FIG. 2, the arrows indicate the flows of the refrigerant in the case where the distributing and joining flow passage 51*a* of the stacking type header 51 functions as the distributing flow passage.

As illustrated in FIG. 2, the stacking type header 51 is constructed in such a manner that a first plate-like member 53 including a partial flow passage 53*a* formed therein, a plurality of second plate-like members 54_1 to 54_3 including partial flow passages 54*a*_1 to 54*a*_3 formed therein, and a third plate-like member 55 including partial flow passages 55*a* formed therein are stacked through intermediation of a plurality of cladding members 56_1 to 56_4 including partial flow passages 56*a* formed therein. A brazing material is applied to one or both surfaces of each of the cladding members 56_1 to 56_4. In the following, in some cases, the first plate-like member 53, the plurality of second plate-like members 54_1 to 54_3, the third plate-like member 55, and the plurality of cladding members 56_1 to 56_4 are collectively referred to as the "plate-like member".

Each of the partial flow passages 53*a*, 55*a*, and 56*a* is a circular through hole. Each of the partial flow passages 54*a*_1 to 54*a*_3 is a linear (for example, Z-shaped or S-shaped) through groove in which the height of the end portion on the one side in the gravity direction and the height of the end portion on the other side in the gravity direction are different from each other. The refrigerant pipe (not shown) is connected to the partial flow passage 53*a* through the connection pipe 52. The windward heat transfer tube 22 is connected to each of the partial flow passages 55*a* through a connection pipe 57. The connection pipe 57 is, for example, a circular pipe. The partial flow passage 55*a* may be a through hole shaped along the outer peripheral surface of the windward heat transfer tube 22 so that the windward heat transfer tube 22 is directly connected to the through hole without the connection pipe 57.

The partial flow passage 56*a* of the cladding member 56_1 is formed at a position opposed to the partial flow passage 53*a*. The partial flow passages 56*a* of the cladding member 56_4 are each formed at a position opposed to a corresponding one of the partial flow passages 55*a*. The end portion on the one side and the end portion on the other side of each of the partial flow passages 54*a*_1 to 54*a*_3 are opposed to the partial flow passages 56*a* of a corresponding one of the cladding members 56_2 to 56_4 stacked adjacently on a side closer to the windward heat exchanging unit 21. A part of a portion between the end portion on the one side and the end portion on the other side of each of the partial flow passages 54*a*_1 to 54*a*_3 is opposed to the partial flow passage 56*a* of a corresponding one of the cladding members 56_1 to 56_3 stacked adjacently on a side farther away from the windward heat exchanging unit 21.

When the plate-like members are stacked, the partial flow passages 53*a*, 54*a*_1 to 54*a*_3, 55*a*, and 56*a* are communicated with each other so that the distributing and joining flow passage 51*a* is formed. The distributing and joining flow passage 51*a* functions as the distributing flow passage when the refrigerant flows in a direction indicated by the arrows in FIG. 2, and functions as the joining flow passage when the refrigerant flows in a direction opposite to the direction indicated by the arrows in FIG. 2.

When the distributing and joining flow passage 51*a* functions as the distributing flow passage, the refrigerant passing through the connection pipe 52 to flow into the partial flow passage 53*a* passes through the partial flow passage 56*a* to flow into a portion between the end portion on the one side and the end portion on the other side of the partial flow passage 54*a*_1, and hits against the surface of the cladding member 56_2 so that the refrigerant is branched in two directions. The branched refrigerant flows out of the partial flow passage 54*a*_1 through each of the end portion on the one side and the end portion on the other side of the partial flow passage 54*a*_1. Then, the refrigerant passes through the partial flow passage 56*a* to flow into a portion between the end portion on the one side and the end portion on the other side of the partial flow passage 54*a*_2, and hits against the surface of the cladding member 56_3 so that the refrigerant is branched in two directions. The branched refrigerant flows out of the partial flow passage 54*a*_2 through each of the end portion on the one side and the end portion on the other side of the partial flow passage 54*a*_2. Then, the refrigerant passes through the partial flow passage 56*a* to flow into a portion between the end portion on the one side and the end portion on the other side of the partial flow passage 54*a*_3, and hits against the surface of the cladding member 56_4 so that the refrigerant is branched in two directions. The branched refrigerant flows out of the partial flow passage 54*a*_3 through each of the end portion on the one side and the end portion on the other side of the partial flow passage 54*a*_3. Then, the refrigerant passes through the partial flow passage 56*a* and the partial flow passage 55*a* to flow into the connection pipe 57.

When the distributing and joining flow passage 51*a* functions as the joining flow passage, the refrigerant passing through the connection pipes 57 to flow into the partial flow passages 55*a* passes through the partial flow passages 56*a* to flow into the end portion on the one side and the end portion on the other side of each of the partial flow passages 54*a*_3, and then flows into a corresponding one of the partial flow passages 56*a* communicated with the portion between the end portion on the one side and the end portion on the other side of the partial flow passage 54*a*_3 so that the flows of the refrigerant are joined to each other. The respective joined refrigerant flows into the end portion on the one side and the end portion on the other side of each of the partial flow passages 54*a*_2, and then flows into a corresponding one of the partial flow passages 56*a* communicated with the portion between the end portion on the one side and the end portion on the other side of the partial flow passage 54*a*_2 so that the flows of the refrigerant are joined to each other. The respective joined refrigerant flows into the end portion on the one side and the end portion on the other side of each of the partial flow passage 54*a*_1, and then flows into the partial flow passage 56*a* communicated with the portion between the end portion on the one side and the end portion on the other side of the partial flow passage 54*a*_1 so that the flows of the refrigerant are joined to each other. The joined refrigerant passes through the partial flow passage 53*a* to flow into the connection pipe 52.

Note that, the first plate-like member 53, the second plate-like members 54_1 to 54_3, and the third plate-like member 55 may be directly stacked without the cladding members 56_1 to 56_4. When the first plate-like member 53, the second plate-like members 54_1 to 54_3, and the third plate-like member 55 are stacked through intermediation of the cladding members 56_1 to 56_4, the partial flow passages 56*a* function as refrigerant partitioning flow passages so that the flows of the refrigerant passing through the partial flow passages 53*a*, 54*a*_1 to 54*a*_3, and 55*a* are reliably partitioned from each other. Further, plate-like members obtained by integrating the first plate-like member 53, the second plate-like members 54_1 to 54_3, and the third plate-like member 55 with the cladding members 56_1 to 56_4 stacked adjacent to the corresponding plate-like members may be directly stacked.

(Configuration of Tubular Header)

The configuration of the tubular header of the heat exchanger according to Embodiment 1 is described below.

Figure 3:
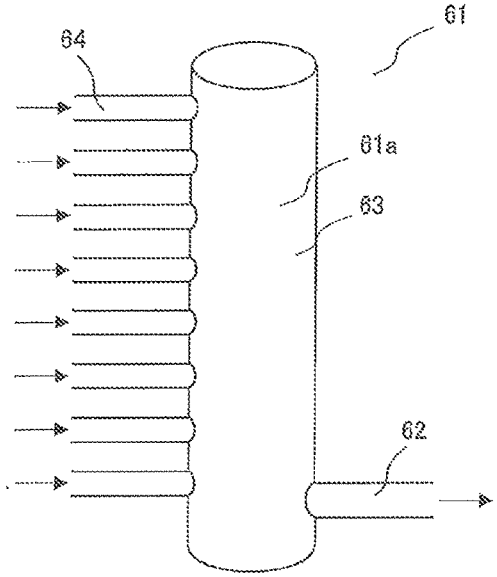
FIG. 3 is a perspective view of a tubular header of the heat exchanger according to Embodiment 1.

FIG. 3 is a perspective view of the tubular header of the heat exchanger according to Embodiment 1. Note that, in FIG. 3, the arrows indicate the flows of the refrigerant in the case where the distributing and joining flow passage 61*a* of the tubular header 61 functions as the joining flow passage.

As illustrated in FIG. 3, the tubular header 61 is arranged so that an axial direction of a cylindrical portion 63 having a closed end portion on one side and a closed end portion on the other side is parallel to the gravity direction. The axial direction of the cylindrical portion 63 is not limited to be parallel to the gravity direction. When the tubular header 61 is arranged so that the axial direction of the cylindrical portion 63 is parallel to a longitudinal direction of the stacking type header 51, space saving is achieved in the distributing and joining unit 3. Note that, the cylindrical portion 63 may be, for example, a tubular portion having an elliptical shape in cross section.

The refrigerant pipe (not shown) is connected to a side wall of the cylindrical portion 63 through the connection pipe 62. The leeward heat transfer tubes 32 are connected to the side wall of the cylindrical portion 63 through a plurality of connection pipes 64. Each of the connection pipes 64 is, for example, a circular pipe. The leeward heat transfer tubes 32 may be directly connected to the side wall of the cylindrical portion 63 without the connection pipes 64. The distributing and joining flow passage 61*a* is formed inside the cylindrical portion 63. The distributing and joining flow passage 61*a* functions as the joining flow passage when the refrigerant flows in a direction indicated by the arrows in FIG. 3, and functions as the distributing flow passage when the refrigerant flows in a direction opposite to the direction indicated by the arrows in FIG. 3.

When the distributing and joining flow passage 61*a* functions as the joining flow passage, the refrigerant flowing into the plurality of connection pipes 64 passes through an inside of the cylindrical portion 63 to flow into the connection pipe 62 so that the flows of the refrigerant are joined to each other. When the distributing and joining flow passage 61*a* functions as the distributing flow passage, the refrigerant flowing into the connection pipe 62 passes through the inside of the cylindrical portion 63 to flow into each of the plurality of connection pipes 64 so that the refrigerant is distributed.

The connection pipe 62 and the plurality of connection pipes 64 are preferably connected so that, among circumferential directions of the cylindrical portion 63, a direction of connection of the connection pipe 62 and a direction of connection of each of the plurality of connection pipes 64 are not aligned in a straight line. With this configuration, it is possible to enhance the uniformity in distribution of the refrigerant flowing into the plurality of connection pipes 64 when the distributing and joining flow passage 61*a* functions as the distributing flow passage.

(Connection Between Heat Exchanging Unit and Distributing and Joining Unit)

Connection between the heat exchanging unit and the distributing and joining unit of the heat exchanger according to Embodiment 1 is described below.

Figure 4:
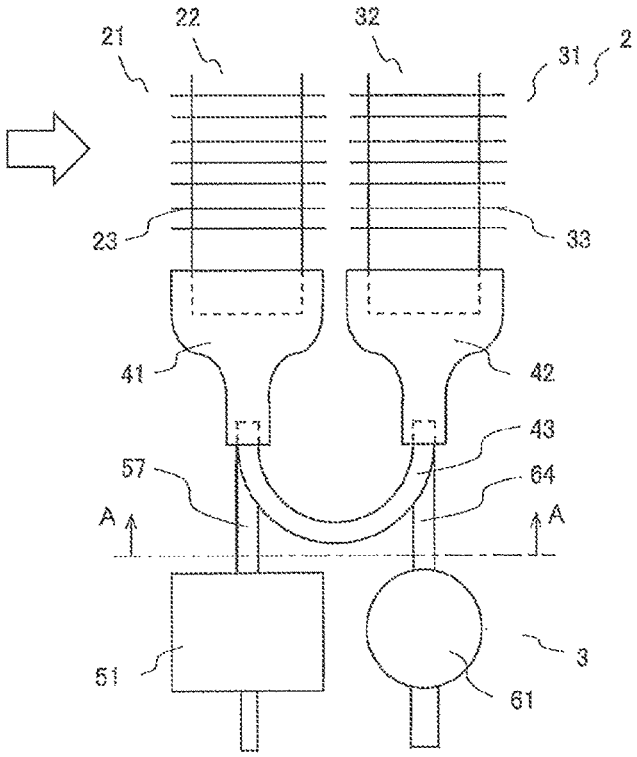
FIG. 4 is an explanatory view for illustrating connection between a heat exchanging unit and a distributing and joining unit of the heat exchanger according to Embodiment 1.
Figure 5:
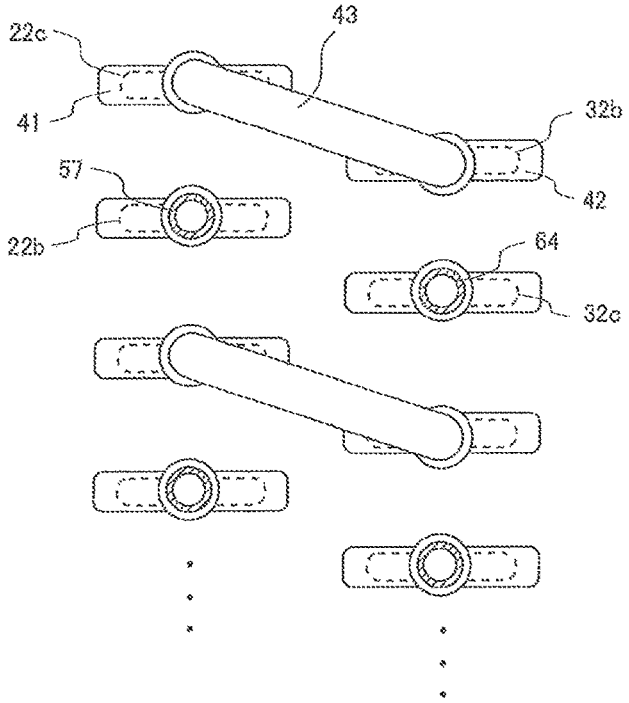
FIG. 5 is an explanatory view for illustrating the connection between the heat exchanging unit and the distributing and joining unit of the heat exchanger according to Embodiment 1.

FIG. 4 and FIG. 5 are explanatory views for illustrating the connection between the heat exchanging unit and the distributing and joining unit of the heat exchanger according to Embodiment 1. Note that, FIG. 5 is a sectional view taken along the line A-A of FIG. 4.

As illustrated in FIG. 4 and FIG. 5, a windward joint member 41 is joined to each of an end portion 22*b* on one side and an end portion 22*c* on the other side of the windward heat transfer tube 22. A flow passage is formed inside the windward joint member 41. An end portion on one side of the flow passage is shaped along the outer peripheral surface of the windward heat transfer tube 22, whereas an end portion on the other side of the flow passage is formed into a circular shape. A leeward joint member 42 is joined to each of an end portion 32*b* on one side and an end portion 32*c* on the other side of the leeward heat transfer tube 32. A flow passage is formed inside the leeward joint member 42. An end portion on one side of the flow passage is shaped along the outer peripheral surface of the leeward heat transfer tube 32, whereas an end portion on the other side of the flow passage is formed into a circular shape.

The windward joint member 41 joined to the end portion 22*c* on the other side of the windward heat transfer tube 22 and the leeward joint member 42 joined to the end portion 32*b* on the one side of the leeward heat transfer tube 32 are connected to each other through a lateral bridging pipe 43. The lateral bridging pipe 43 is, for example, a circular pipe bent into an arc shape. The connection pipe 57 of the stacking type header 51 is connected to the windward joint member 41 joined to the end portion 22*b* on the one side of the windward heat transfer tube 22. The connection pipe 64 of the tubular header 61 is connected to the leeward joint member 42 joined to the end portion 32*c* on the other side of the leeward heat transfer tube 32. A flow passage formed inside the lateral bridging pipe 43 corresponds to a "second turn-back portion" of the present invention.

The windward joint member 41 and the connection pipe 57 may be integrated with each other. Further, the leeward joint member 42 and the connection pipe 64 may be integrated with each other. Still further, the windward joint member 41, the leeward joint member 42, and the lateral bridging pipe 43 may be integrated with each other.

Figure 6:
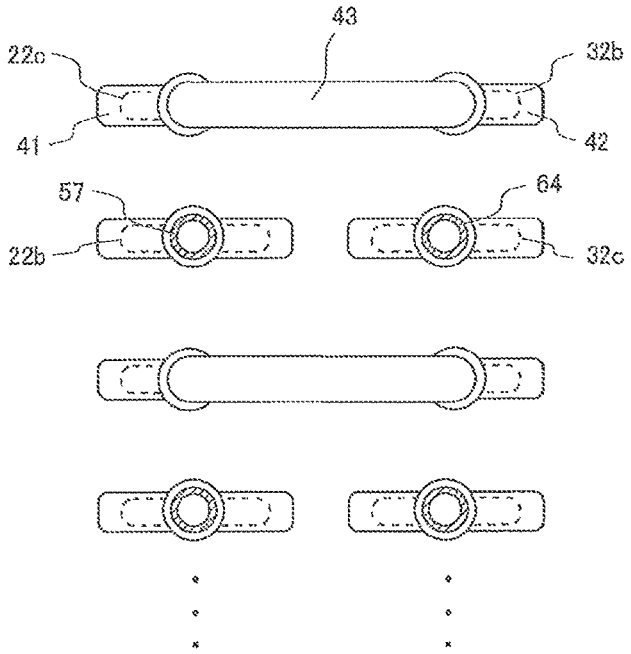
FIG. 6 is an explanatory view for illustrating connection between the heat exchanging unit and the distributing and joining unit in a modified example of the heat exchanger according to Embodiment 1.

FIG. 6 is an explanatory view for illustrating connection between the heat exchanging unit and the distributing and joining unit in a modified example of the heat exchanger according to Embodiment 1. Note that, FIG. 6 is a sectional view taken along the line corresponding to the line A-A of FIG. 4.

Note that, the windward heat transfer tube 22 and the leeward heat transfer tube 32 may be arranged so that the end portion 22*b* on the one side and the end portion 22*c* on the other side of the windward heat transfer tube 22 and the end portion 32*b* on the one side and the end portion 32*c* on the other side of the leeward heat transfer tube 32 are arranged in a staggered pattern in side view of the heat exchanger 1 as illustrated in FIG. 5, or alternatively in a lattice pattern in side view of the heat exchanger 1 as illustrated in FIG. 6.

Figure 7:
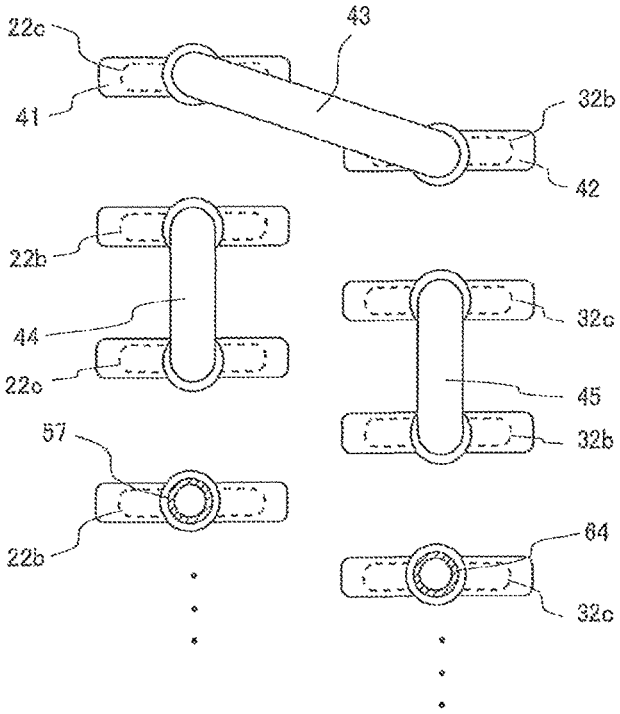
FIG. 7 is an explanatory view for illustrating connection between the heat exchanging unit and the distributing and joining unit in a modified example of the heat exchanger according to Embodiment 1.
Figure 8:
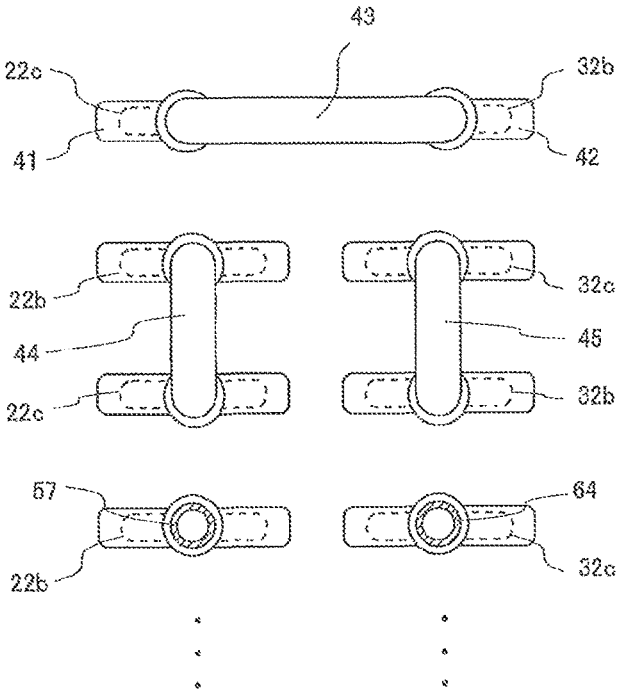
FIG. 8 is an explanatory view for illustrating connection between the heat exchanging unit and the distributing and joining unit in a modified example of the heat exchanger according to Embodiment 1.

FIG. 7 and FIG. 8 are explanatory views for illustrating connection between the heat exchanging unit and the distributing and joining unit in modified examples of the heat exchanger according to Embodiment 1. Note that, FIG. 7 and FIG. 8 are sectional views taken along the lines corresponding to the line A-A of FIG. 4.

Further, as illustrated in FIG. 7 and FIG. 8, the end portion 22*c* on the other side of the windward heat transfer tube 22 and the end portion 22*b* on the one side of the windward heat transfer tube 22 in a stage above a stage of the above-mentioned windward heat transfer tube 22 may be connected to each other through a windward vertical bridging pipe 44, and the end portion 32*c* on the other side of the leeward heat transfer tube 32 and the end portion 32*b* on the one side of the leeward heat transfer tube 32 in a stage below a stage of the above-mentioned leeward heat transfer tube 32 may be connected to each other through a leeward vertical bridging pipe 45. Each of the windward vertical bridging pipe 44 and the leeward vertical bridging pipe 45 is, for example, a circular pipe bent into an arc shape. A flow passage formed inside the windward vertical bridging pipe 44 corresponds to the "second turn-back portion" of the present invention. A flow passage formed inside the leeward vertical bridging pipe 45 also corresponds to the "second turn-back portion" of the present invention.

<Configuration of Air-Conditioning Apparatus to which Heat Exchanger is Applied>

The configuration of the air-conditioning apparatus to which the heat exchanger according to Embodiment 1 is applied is described below.

Figure 9:
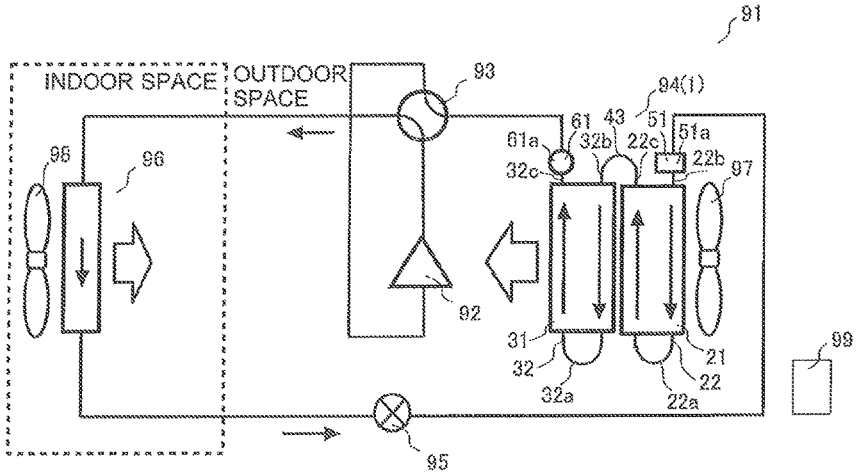
FIG. 9 is a diagram for illustrating a configuration of an air-conditioning apparatus to which the heat exchanger according to Embodiment 1 is applied.
Figure 10:
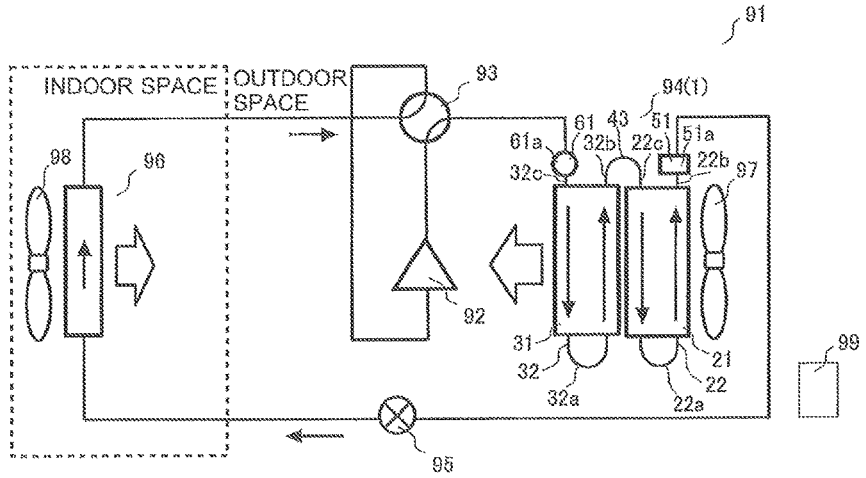
FIG. 10 is a diagram for illustrating the configuration of the air-conditioning apparatus to which the heat exchanger according to Embodiment 1 is applied.

FIG. 9 and FIG. 10 are diagrams for illustrating the configuration of the air-conditioning apparatus to which the heat exchanger according to Embodiment 1 is applied. Note that, FIG. 9 is an illustration of a case where an air-conditioning apparatus 91 performs a heating operation. Further, FIG. 10 is an illustration of a case where the air-conditioning apparatus 91 performs a cooling operation.

As illustrated in FIG. 9 and FIG. 10, the air-conditioning apparatus 91 includes a compressor 92, a four-way valve 93, an outdoor heat exchanger (heat source-side heat exchanger) 94, an expansion device 95, an indoor heat exchanger (load-side heat exchanger) 96, an outdoor fan (heat source-side fan) 97, an indoor fan (load-side fan) 98, and a controller 99. The compressor 92, the four-way valve 93, the outdoor heat exchanger 94, the expansion device 95, and the indoor heat exchanger 96 are connected by refrigerant pipes to form a refrigerant circuit. The four-way valve 93 may be any other flow switching device.

The outdoor heat exchanger 94 corresponds to the heat exchanger 1. The heat exchanger 1 is provided so that the stacking type header 51 is arranged on a windward side of an air flow to be generated through drive of the outdoor fan 97, whereas the tubular header 61 is arranged on a leeward side of the air flow. The outdoor fan 97 may be arranged on the windward side of the heat exchanger 1, or on the leeward side of the heat exchanger 1.

The controller 99 is connected to, for example, the compressor 92, the four-way valve 93, the expansion device 95, the outdoor fan 97, the indoor fan 98, and various sensors. The controller 99 switches the flow passage of the four-way valve 93 to switch between the heating operation and the cooling operation.

<Operations of Heat Exchanger and Air-Conditioning Apparatus>

The operations of the heat exchanger according to Embodiment 1 and the air-conditioning apparatus to which the heat exchanger is applied are described below.

(Operations of Heat Exchanger and Air-Conditioning Apparatus During Heating Operation)

With reference to FIG. 9, the flow of the refrigerant during the heating operation is described below.

The refrigerant in a high-pressure and high-temperature gas state discharged from the compressor 92 passes through the four-way valve 93 to flow into the indoor heat exchanger 96, and is condensed through heat exchange with air supplied by the indoor fan 98, to thereby heat the inside of the room. The condensed refrigerant is brought into a high-pressure subcooled liquid state to flow out of the indoor heat exchanger 96. The refrigerant then turns into refrigerant in a low-pressure two-phase gas-liquid state by the expansion device 95. The refrigerant in the low-pressure two-phase gas-liquid state flows into the outdoor heat exchanger 94, and is evaporated through heat exchange with air supplied by the outdoor fan 97. The evaporated refrigerant is brought into a low-pressure superheated gas state to flow out of the outdoor heat exchanger 94. The refrigerant then passes through the four-way valve 93 to be sucked into the compressor 92. That is, during the heating operation, the outdoor heat exchanger 94 acts as an evaporator.

In the outdoor heat exchanger 94, the refrigerant flows into the distributing and joining flow passage 51*a* of the stacking type header 51 so that the refrigerant is distributed to flow into the end portion 22*b* on the one side of the windward heat transfer tube 22 of the windward heat exchanging unit 21. The refrigerant flowing into the end portion 22*b* on the one side of the windward heat transfer tube 22 passes through the turn-back portion 22*a* to reach the end portion 22*c* on the other side of the windward heat transfer tube 22. The refrigerant passes through the lateral bridging pipe 43 to flow into the end portion 32*b* on the one side of the leeward heat transfer tube 32 of the leeward heat exchanging unit 31. The refrigerant flowing into the end portion 32*b* on the one side of the leeward heat transfer tube 32 passes through the turn-back portion 32*a* to reach the end portion 32*c* on the other side of the leeward heat transfer tube 32. The refrigerant flows into the distributing and joining flow passage 61*a* of the tubular header 61 so that the refrigerant is joined.

(Operations of Heat Exchanger and Air-Conditioning Apparatus During Cooling Operation)

With reference to FIG. 10, the flow of the refrigerant during the cooling operation is described below.

The refrigerant in a high-pressure and high-temperature gas state discharged from the compressor 92 passes through the four-way valve 93 to flow into the outdoor heat exchanger 94, and is condensed through heat exchange with air supplied by the outdoor fan 97. The condensed refrigerant is brought into a high-pressure subcooled liquid state (or a low-quality two-phase gas-liquid state) to flow out of the outdoor heat exchanger 94. The refrigerant is then brought into a low-pressure two-phase gas-liquid state by the expansion device 95. The refrigerant in the low-pressure two-phase gas-liquid state flows into the indoor heat exchanger 96, and is evaporated through heat exchange with air supplied by the indoor fan 98, to thereby cool the inside of the room. The evaporated refrigerant is brought into a low-pressure superheated gas state to flow out of the indoor heat exchanger 96. The refrigerant then passes through the four-way valve 93 to be sucked into the compressor 92. That is, during the cooling operation, the outdoor heat exchanger 94 acts as a condenser.

In the outdoor heat exchanger 94, the refrigerant flows into the distributing and joining flow passage 61*a* of the tubular header 61 so that the refrigerant is distributed to flow into the end portion 32*c* on the other side of the leeward heat transfer tube 32 of the leeward heat exchanging unit 31. The refrigerant flowing into the end portion 32*c* on the other side of the leeward heat transfer tube 32 passes through the turn-back portion 32*a* to reach the end portion 32*b* on the one side of the leeward heat transfer tube 32. The refrigerant passes through the lateral bridging pipe 43 to flow into the end portion 22*c* on the other side of the windward heat transfer tube 22 of the windward heat exchanging unit 21. The refrigerant flowing into the end portion 22*c* on the other side of the windward heat transfer tube 22 passes through the turn-back portion 22*a* to reach the end portion 22*b* on the one side of the windward heat transfer tube 22. The refrigerant flows into the distributing and joining flow passage 51*a* of the stacking type header 51 so that the refrigerant is joined.

<Actions of Heat Exchanger>

Actions of the heat exchanger according to Embodiment 1 are described below.

Figure 11:
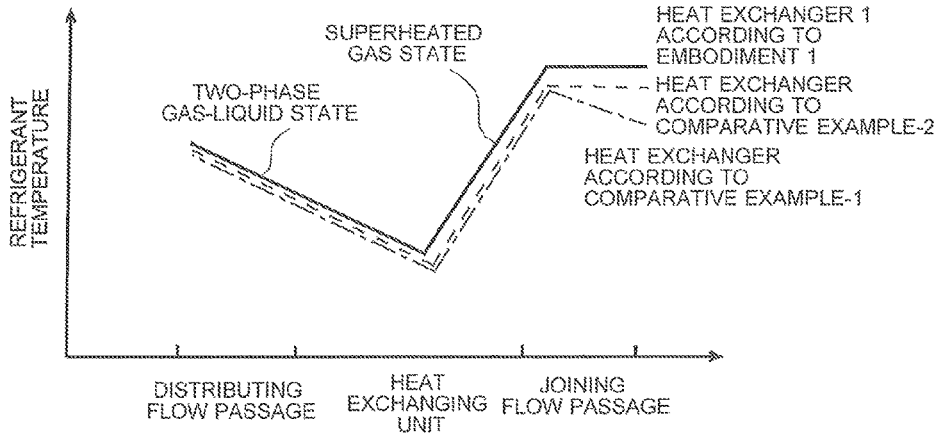
FIG. 11 is a graph for showing an overview of refrigerant temperature change in a case where the heat exchanger according to Embodiment 1 acts as an evaporator.
Figure 12:
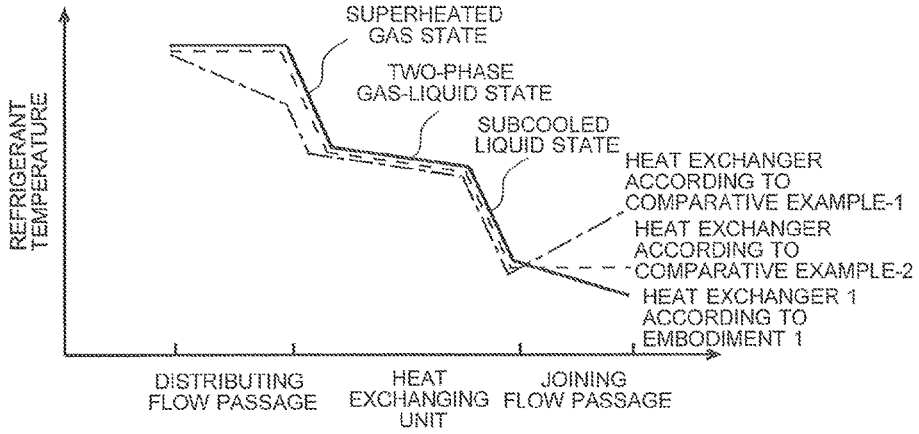
FIG. 12 is a graph for showing an overview of refrigerant temperature change in a case where the heat exchanger according to Embodiment 1 acts as a condenser.

FIG. 11 is a graph for showing an overview of refrigerant temperature change in the case where the heat exchanger according to Embodiment 1 acts as an evaporator. FIG. 12 is a graph for showing an overview of refrigerant temperature change in the case where the heat exchanger according to Embodiment 1 acts as a condenser. Note that, in FIG. 11 and FIG. 12, the refrigerant temperature change in the heat exchanger 1 according to Embodiment 1 is indicated by the solid line. Further, a heat exchanger in a case where the distributing flow passage and the joining flow passage are formed in a single header is provided as a heat exchanger according to Comparative Example-1, and the refrigerant temperature change in this heat exchanger is indicated by the chain line. Still further, a heat exchanger in a case where the distributing flow passage and the joining flow passage are formed in separate headers and both of the headers are not stacking type headers is provided as a heat exchanger according to Comparative Example-2, and the refrigerant temperature change in this heat exchanger is indicated by the broken line.

(Actions of Heat Exchanger According to Comparative Example-1)

With reference to FIG. 11 and FIG. 12, actions of the heat exchanger according to Comparative Example-1 are described.

When the heat exchanger acts as an evaporator, refrigerant in a two-phase gas-liquid state flows into the heat exchanger. Thus, the refrigerant in the two-phase gas-liquid state passes through the distributing flow passage, the heat transfer tube of the heat exchanger, and other portions, and the resistance of the flow passages causes a pressure drop to decrease the saturation temperature of the refrigerant. Thus, the refrigerant temperature is decreased. In this process, when the refrigerant is heated by air and thus completely evaporated, the refrigerant is brought into a superheated gas state, and hence the refrigerant temperature is increased. The refrigerant flowing out of the leeward heat exchanging unit flows into the joining flow passage at a higher temperature than that of a case where the refrigerant flows into the distributing flow passage. The distributing flow passage and the joining flow passage are formed in a single header, and hence the refrigerant flowing into the joining flow passage is cooled through heat exchange with the refrigerant yet to be heated and passing through the distributing flow passage.

Further, when the heat exchanger acts as a condenser, refrigerant in a superheated gas state flows into the heat exchanger. The distributing flow passage and the joining flow passage are formed in a single header, and hence the refrigerant flowing into the distributing flow passage is cooled through heat exchange with the cooled refrigerant passing through the joining flow passage. The refrigerant passing through the distributing flow passage passes through the heat transfer tube of the heat exchanger and other portions to be brought into a two-phase gas-liquid state and then a subcooled liquid state, and then flows into the joining flow passage. The distributing flow passage and the joining flow passage are formed in a single header, and hence the refrigerant flowing into the joining flow passage is heated through heat exchange with the refrigerant yet to be cooled and passing through the distributing flow passage.

(Actions of Heat Exchanger According to Comparative Example-2)

With reference to FIG. 11 and FIG. 12, actions of the heat exchanger according to Comparative Example-2 are described.

In the heat exchanger according to Comparative Example-2, the distributing flow passage and the joining flow passage are formed in separate headers unlike the heat exchanger according to Comparative Example-1. Thus, when the heat exchanger acts as an evaporator, the refrigerant flowing into the joining flow passage does not exchange heat with the refrigerant yet to be heated and passing through the distributing flow passage, thereby controlling the decrease in temperature of the heated refrigerant. As a result, the heat exchange efficiency is enhanced. Further, when the heat exchanger acts as a condenser, the refrigerant flowing into the joining flow passage does not exchange heat with the refrigerant yet to be cooled and passing through the distributing flow passage, thereby controlling the increase in temperature of the cooled refrigerant. As a result, the heat exchange efficiency is enhanced.

(Actions of Heat Exchanger According to Embodiment 1 when Acting as Evaporator)

With reference to FIG. 11, actions of the heat exchanger according to Embodiment 1 when the heat exchanger acts as an evaporator are described.

In the heat exchanger 1, similarly to the heat exchanger according to Comparative Example-2, when the heat exchanger 1 acts as an evaporator, the distributing and joining flow passage 51*a* that functions as the distributing flow passage and the distributing and joining flow passage 61*a* that functions as the joining flow passage are formed in the stacking type header 51 and the tubular header 61, respectively, that is, formed in separate headers, thereby controlling the decrease in temperature of the heated refrigerant. As a result, the heat exchange efficiency is enhanced.

Further, in the heat exchanger 1, the distributing and joining flow passage 51*a* that functions as the distributing flow passage is formed in the stacking type header 51, and hence the refrigerant flowing into the distributing and joining flow passage 61*a* that functions as the joining flow passage has an even higher temperature. As a result, the heat exchange efficiency is enhanced. That is, the stacking type header 51 has a larger surface area than, for example, a distributor including capillary tubes partially arranged in flow passages, and hence, before flowing into the windward heat exchanging unit 21, the refrigerant passing through the distributing and joining flow passage 51*a* is heated by the air supplied to the heat exchanger 1 along with the drive of the outdoor fan 97. Further, in the stacking type header 51, the refrigerant passes through the distributing and joining flow passage 51*a* while the refrigerant is finely branched, and hence the performance of heat transfer from the outer surface of the header to the refrigerant is enhanced as compared to the tubular header 61 or other portions. Thus, before flowing into the windward heat exchanging unit 21, the refrigerant passing through the distributing and joining flow passage 51*a* is further heated by the air supplied to the heat exchanger 1 along with the drive of the outdoor fan 97. As a result, the refrigerant is completely evaporated in an early stage when passing through the distributing and joining flow passage 51*a*, the windward heat transfer tube 22, the leeward heat transfer tube 32, or other portions. Thus, the refrigerant flowing into the distributing and joining flow passage 61*a* that functions as the joining flow passage has an even higher temperature.

Still further, the stacking type header 51 is arranged on the windward side with respect to the tubular header 61, and hence the air supplied to the heat exchanger 1 along with the drive of the outdoor fan 97 hits against the stacking type header 51 before the air is cooled. Thus, before flowing into the windward heat exchanging unit 21, the refrigerant passing through the distributing and joining flow passage 51*a* is further heated. As a result, the heat exchange efficiency is further enhanced. In particular, when the stacking type header 51 and the tubular header 61 are juxtaposed along the passing direction of the air supplied to the heat exchanger 1 along with the drive of the outdoor fan 97, the stacking type header 51 serves as an air screen for the tubular header 61 to enhance the aerodynamic performance of the outdoor fan 97, and the heat exchanging unit 2 can be upsized to enhance the heat exchange efficiency.

Yet further, the distributing and joining flow passage 51*a* of the stacking type header 51 allows the refrigerant to be distributed by repeatedly branching the refrigerant into two flows, thereby controlling decrease in uniformity in distribution of the refrigerant flowing into the plurality of windward heat transfer tubes 22 and the plurality of leeward heat transfer tubes 32. Specifically, as described above, the refrigerant passing through the distributing and joining flow passage 51*a* is heated to a higher degree than refrigerant in the heat exchanger according to Comparative Example-1 or the heat exchanger according to Comparative Example-2, and hence the quality approximates 50% so that the refrigerant is liable to be affected by the gravity or another factor. As a result, it is difficult to uniformly distribute the refrigerant to the plurality of windward heat transfer tubes 22. However, the distributing and joining flow passage 51*a* of the stacking type header 51 allows the refrigerant to be distributed by repeatedly branching the refrigerant into two flows, and hence the refrigerant is less liable to be affected by the gravity or another factor even under such a situation.

As a result, it is possible to uniformly distribute the refrigerant to the plurality of windward heat transfer tubes 22.

(Actions of Heat Exchanger According to Embodiment 1 when Acting as Condenser)

With reference to FIG. 12, actions of the heat exchanger according to Embodiment 1 when the heat exchanger acts as a condenser are described.

In the heat exchanger 1, similarly to the heat exchanger according to Comparative Example-2, when the heat exchanger 1 acts as a condenser, the distributing and joining flow passage 61*a* that functions as the distributing flow passage and the distributing and joining flow passage 51*a* that functions as the joining flow passage are formed in the tubular header 61 and the stacking type header 51, respectively, that is, formed in separate headers, thereby controlling the increase in temperature of the cooled refrigerant. As a result, the heat exchange efficiency is enhanced.

Further, in the heat exchanger 1, the distributing and joining flow passage 51*a* that functions as the joining flow passage is formed in the stacking type header 51, and hence the refrigerant flowing out of the distributing and joining flow passage 51*a* that functions as the joining flow passage has an even lower temperature. As a result, the heat exchange efficiency is enhanced. That is, the stacking type header 51 has a larger surface area than, for example, the distributor including capillary tubes partially arranged in the flow passages, and hence, the refrigerant passing through the distributing and joining flow passage 51*a* is cooled by the air supplied to the heat exchanger 1 along with the drive of the outdoor fan 97. Further, in the stacking type header 51, the flows of the refrigerant pass through the distributing and joining flow passage 51*a* while the flows are gradually joined to each other, and hence the performance of heat transfer from the outer surface of the header to the refrigerant is enhanced as compared to the tubular header 61 or other portions. Thus, the refrigerant passing through the distributing and joining flow passage 51*a* is further cooled by the air supplied to the heat exchanger 1 along with the drive of the outdoor fan 97.

Still further, in the heat exchanger 1, when the heat exchanger 1 acts as a condenser, the refrigerant flows from the plurality of leeward heat transfer tubes 32 to the plurality of windward heat transfer tubes 22. That is, the passing direction of the air supplied to the heat exchanger 1 along with the drive of the outdoor fan 97 and the passing direction of the refrigerant in the row direction of the heat exchanging unit 2 have a counterflow relationship therebetween. Thus, the heat exchange efficiency is enhanced, thereby being adaptable to a case where the difference in refrigerant temperature between the inlet and the outlet of the heat exchanger 1 is increased when the heat exchanger 1 acts as a condenser. In addition, the heat exchange efficiency is further enhanced synergistically with the configuration in which the distributing and joining flow passage 61*a* that functions as the distributing flow passage and the distributing and joining flow passage 51*a* that functions as the joining flow passage are formed in separate headers and the distributing and joining flow passage 51*a* that functions as the joining flow passage is formed in the stacking type header 51.

Still further, the stacking type header 51 is arranged on the windward side with respect to the tubular header 61, and hence the air supplied to the heat exchanger 1 along with the drive of the outdoor fan 97 hits against the stacking type header 51 before the air is heated. Thus, the refrigerant passing through the distributing and joining flow passage 51*a* is further cooled. As a result, the heat exchange efficiency is further enhanced. In particular, when the stacking type header 51 and the tubular header 61 are juxtaposed along the passing direction of the air supplied to the heat exchanger 1 along with the drive of the outdoor fan 97, the stacking type header 51 serves as the air screen for the tubular header 61 to enhance the aerodynamic performance of the outdoor fan 97, and the heat exchanging unit 2 can be upsized to enhance the heat exchange efficiency.

Embodiment 2

A heat exchanger according to Embodiment 2 is described.

Note that, overlapping description or similar description to that of Embodiment 1 is appropriately simplified or omitted.

<Configuration of Heat Exchanger>

The configuration of the heat exchanger according to Embodiment 2 is described below.

(Schematic Configuration of Heat Exchanger)

The schematic configuration of the heat exchanger according to Embodiment 2 is described below.

Figure 13:
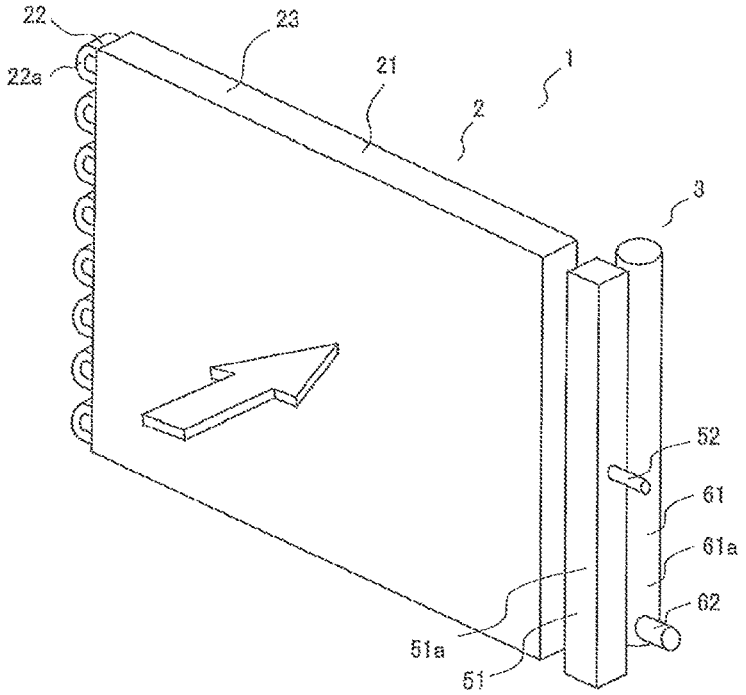
FIG. 13 is a perspective view of a heat exchanger according to Embodiment 2.

FIG. 13 is a perspective view of the heat exchanger according to Embodiment 2.

As illustrated in FIG. 13, the heat exchanging unit 2 includes only the windward heat exchanging unit 21. The windward heat transfer tubes 22 are arranged in a plurality of stages in the direction intersecting with the passing direction of the air passing through the heat exchanging unit 2 (white arrow in FIG. 13). Each of the plurality of windward heat transfer tubes 22 is bent into a hair-pin shape at the portion between the end portion on the one side and the end portion on the other side so that the turn-back portion 22*a* is formed. The end portion on the one side and the end portion on the other side of each of the plurality of windward heat transfer tubes 22 are juxtaposed to be opposed to the stacking type header 51. Each of the windward heat transfer tubes 22 may be a circular tube (for example, a circular tube having a diameter of 4 mm). Each of the plurality of flow passages formed in the flat tube or a flow passage formed in the circular tube corresponds to the "refrigerant flow passage" of the present invention. The turn-back portion 22*a* corresponds to the "first turn-back portion" of the present invention.

The stacking type header 51 is connected to the windward heat exchanging unit 21, and the distributing and joining flow passage 51*a* is formed inside the stacking type header 51. When the heat exchanging unit 2 acts as an evaporator, the distributing and joining flow passage 51*a* serves as the distributing flow passage allowing refrigerant flowing in from the refrigerant pipe (not shown) to be distributed and flow out to the plurality of windward heat transfer tubes 22 of the windward heat exchanging unit 21. When the heat exchanging unit 2 acts as a condenser, the distributing and joining flow passage 51*a* serves as the joining flow passage allowing refrigerant flowing in from the plurality of windward heat transfer tubes 22 of the windward heat exchanging unit 21 to be joined and flow out to the refrigerant pipe (not shown).

The tubular header 61 is connected to the windward heat exchanging unit 21, and the distributing and joining flow passage 61*a* is formed inside the tubular header 61. When the heat exchanging unit 2 acts as a condenser, the distributing and joining flow passage 61*a* serves as the distributing flow passage allowing refrigerant flowing in from the refrigerant pipe (not shown) to be distributed and flow out to the plurality of windward heat transfer tubes 22 of the windward heat exchanging unit 21. When the heat exchanging unit 2 acts as an evaporator, the distributing and joining flow passage 61*a* serves as the joining flow passage allowing refrigerant flowing in from the plurality of windward heat transfer tubes 22 of the windward heat exchanging unit 21 to flow out to the refrigerant pipe (not shown).

That is, when the heat exchanging unit 2 acts as an evaporator, the heat exchanger 1 separately includes the stacking type header 51 including the distributing flow passage (distributing and joining flow passage 51*a*) formed therein and excluding the joining flow passage (distributing and joining flow passage 61*a*), and the tubular header 61 including the joining flow passage (distributing and joining flow passage 61*a*) formed therein and excluding the distributing flow passage (distributing and joining flow passage 51*a*). In such a case, the stacking type header 51 corresponds to the "first header" of the present invention, whereas the tubular header 61 corresponds to the "second header" of the present invention.

Further, when the heat exchanging unit 2 acts as a condenser, the heat exchanger 1 separately includes the tubular header 61 including the distributing flow passage (distributing and joining flow passage 61*a*) formed therein and excluding the joining flow passage (distributing and joining flow passage 51*a*), and the stacking type header 51 including the joining flow passage (distributing and joining flow passage 51*a*) formed therein and excluding the distributing flow passage (distributing and joining flow passage 61*a*). In such a case, the tubular header 61 corresponds to the "first header" of the present invention, whereas the stacking type header 51 corresponds to the "second header" of the present invention.

(Connection Between Heat Exchanging Unit and Distributing and Joining Unit)

Connection between the heat exchanging unit and the distributing and joining unit of the heat exchanger according to Embodiment 2 is described below.

Figure 14:
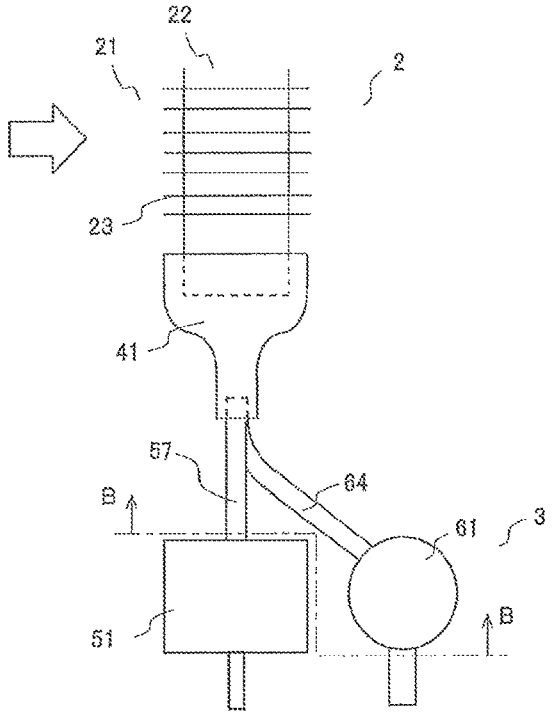
FIG. 14 is an explanatory view for illustrating connection between a heat exchanging unit and a distributing and joining unit of the heat exchanger according to Embodiment 2.
Figure 15:
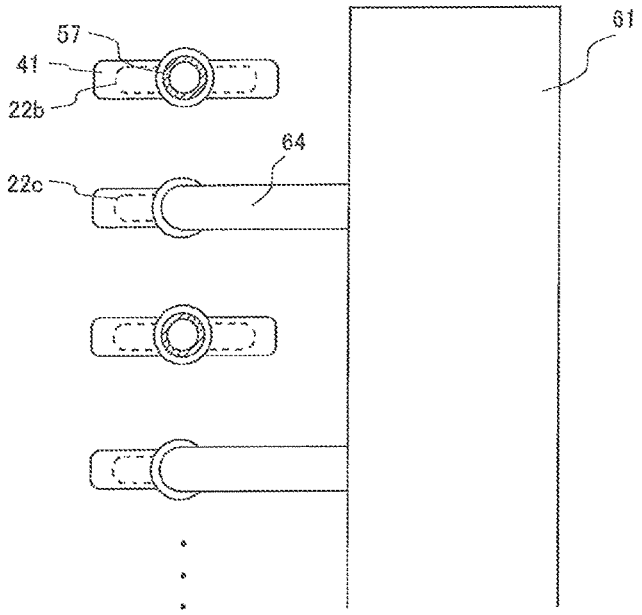
FIG. 15 is an explanatory view for illustrating the connection between the heat exchanging unit and the distributing and joining unit of the heat exchanger according to Embodiment 2.

FIG. 14 and FIG. 15 are explanatory views for illustrating the connection between the heat exchanging unit and the distributing and joining unit of the heat exchanger according to Embodiment 2. Note that, FIG. 15 is a sectional view taken along the line B-B of FIG. 14.

As illustrated in FIG. 14 and FIG. 15, the windward joint member 41 is joined to each of the end portion 22*b* on the one side and the end portion 22*c* on the other side of the windward heat transfer tube 22. The connection pipe 57 of the stacking type header 51 is connected to the windward joint member 41 joined to the end portion 22*b* on the one side of the windward heat transfer tube 22. The connection pipe 64 of the tubular header 61 is connected to the windward joint member 41 joined to the end portion 22*c* on the other side of the windward heat transfer tube 22.

Figure 16:
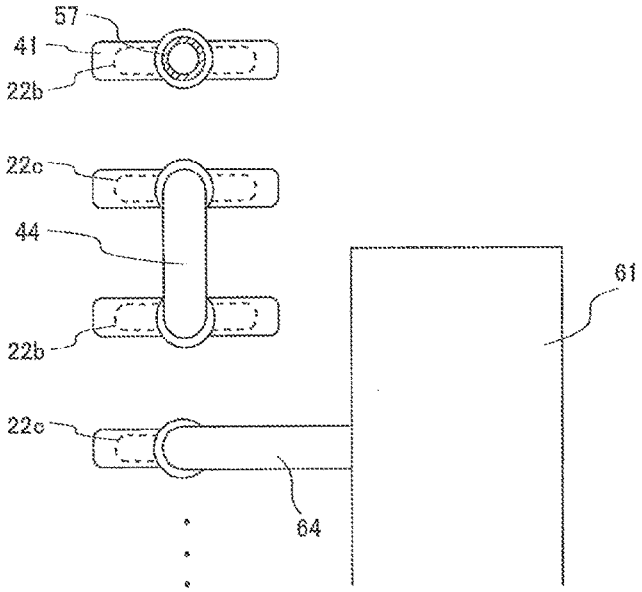
FIG. 16 is an explanatory view for illustrating connection between the heat exchanging unit and the distributing and joining unit in a modified example of the heat exchanger according to Embodiment 2.

FIG. 16 is an explanatory view for illustrating connection between the heat exchanging unit and the distributing and joining unit in a modified example of the heat exchanger according to Embodiment 2. Note that, FIG. 16 is a sectional view taken along the line corresponding to the line B-B of FIG. 14.

As illustrated in FIG. 16, the end portion 22*c* on the other side of the windward heat transfer tube 22 and the end portion 22*b* on the one side of the windward heat transfer tube 22 in a stage below a stage of the above-mentioned windward heat transfer tube 22 may be connected to each other through the windward vertical bridging pipe 44. The flow passage formed inside the windward vertical bridging pipe 44 corresponds to the "second turn-back portion" of the present invention.

<Operations of Heat Exchanger and Air-Conditioning Apparatus>

The operations of the heat exchanger according to Embodiment 2 and the air-conditioning apparatus to which the heat exchanger is applied are described below.

(Operations of Heat Exchanger and Air-Conditioning Apparatus During Heating Operation)

Figure 17:
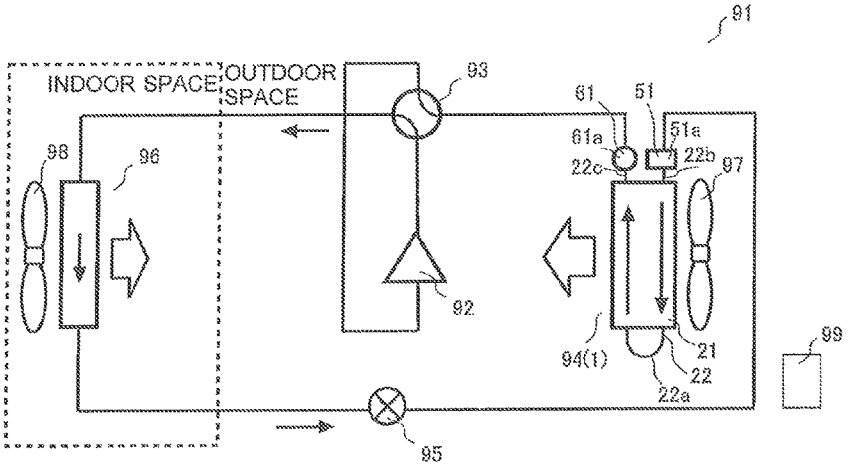
FIG. 17 is a diagram for illustrating a configuration of an air-conditioning apparatus to which the heat exchanger according to Embodiment 2 is applied.

FIG. 17 is a diagram for illustrating the configuration of the air-conditioning apparatus to which the heat exchanger according to Embodiment 2 is applied. Note that, FIG. 17 is an illustration of a case where the air-conditioning apparatus 91 performs the heating operation.

With reference to FIG. 17, the flow of the refrigerant during the heating operation is described below.

In the outdoor heat exchanger 94, the refrigerant flows into the distributing and joining flow passage 51*a* of the stacking type header 51 so that the refrigerant is distributed to flow into the end portion 22*b* on the one side of the windward heat transfer tube 22 of the windward heat exchanging unit 21. The refrigerant flowing into the end portion 22*b* on the one side of the windward heat transfer tube 22 passes through the turn-back portion 22*a* to reach the end portion 22*c* on the other side of the windward heat transfer tube 22. The refrigerant flows into the distributing and joining flow passage 61*a* of the tubular header 61 so that the refrigerant is joined.

(Operations of Heat Exchanger and Air-Conditioning Apparatus During Cooling Operation)

Figure 18:
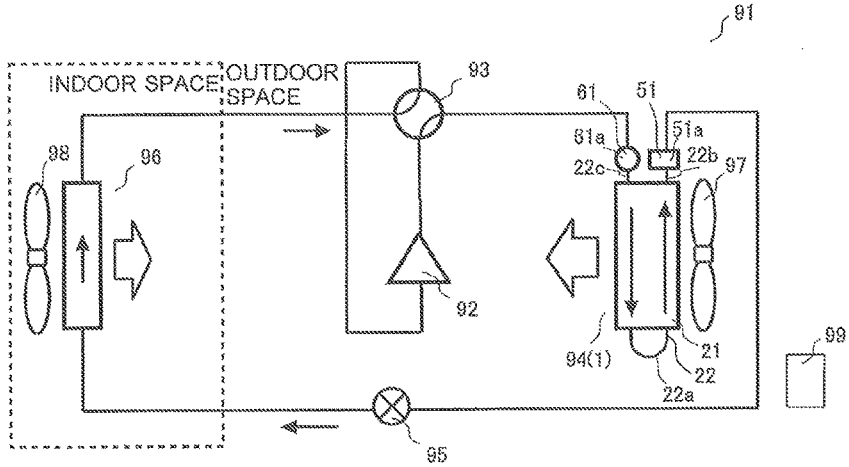
FIG. 18 is a diagram for illustrating the configuration of the air-conditioning apparatus to which the heat exchanger according to Embodiment 2 is applied.

FIG. 18 is a diagram for illustrating the configuration of the air-conditioning apparatus to which the heat exchanger according to Embodiment 2 is applied. Note that, FIG. 18 is an illustration of the case where the air-conditioning apparatus 91 performs the cooling operation.

With reference to FIG. 18, the flow of the refrigerant during the cooling operation is described below.

In the outdoor heat exchanger 94, the refrigerant flows into the distributing and joining flow passage 61*a* of the tubular header 61 so that the refrigerant is distributed to flow into the end portion 22*c* on the other side of the windward heat transfer tube 22 of the windward heat exchanging unit 21. The refrigerant flowing into the end portion 22*c* on the other side of the windward heat transfer tube 22 passes through the turn-back portion 22*a* to reach the end portion 22*b* on the one side of the windward heat transfer tube 22. The refrigerant flows into the distributing and joining flow passage 51*a* of the stacking type header 51 so that the refrigerant is joined.

<Actions of Heat Exchanger>

Actions of the heat exchanger according to Embodiment 2 are described below.

Also in the heat exchanger 1 according to Embodiment 2, the refrigerant temperature is changed similarly to the heat exchanger 1 according to Embodiment 1, that is, similarly to FIG. 11 and FIG. 12. In other words, also in the heat exchanger 1 according to Embodiment 2, similar actions to those of the heat exchanger 1 according to Embodiment 1 are attained.

Embodiment 3

A heat exchanger according to Embodiment 3 is described.

Note that, overlapping description or similar description to that of each of Embodiment 1 and Embodiment 2 is appropriately simplified or omitted. Further, in the following, there is described a case where two rows of the heat exchanging units 2 of the heat exchanger 1 are constructed as in the heat exchanger 1 according to Embodiment 1, but the heat exchanging unit 2 of the heat exchanger 1 may be constructed of a single row of the heat exchanging unit as in the heat exchanger 1 according to Embodiment 2.

<Configuration of Heat Exchanger>

The configuration of the heat exchanger according to Embodiment 3 is described below.

(Schematic Configuration of Heat Exchanger)

The schematic configuration of the heat exchanger according to Embodiment 3 is described below.

Figure 19:
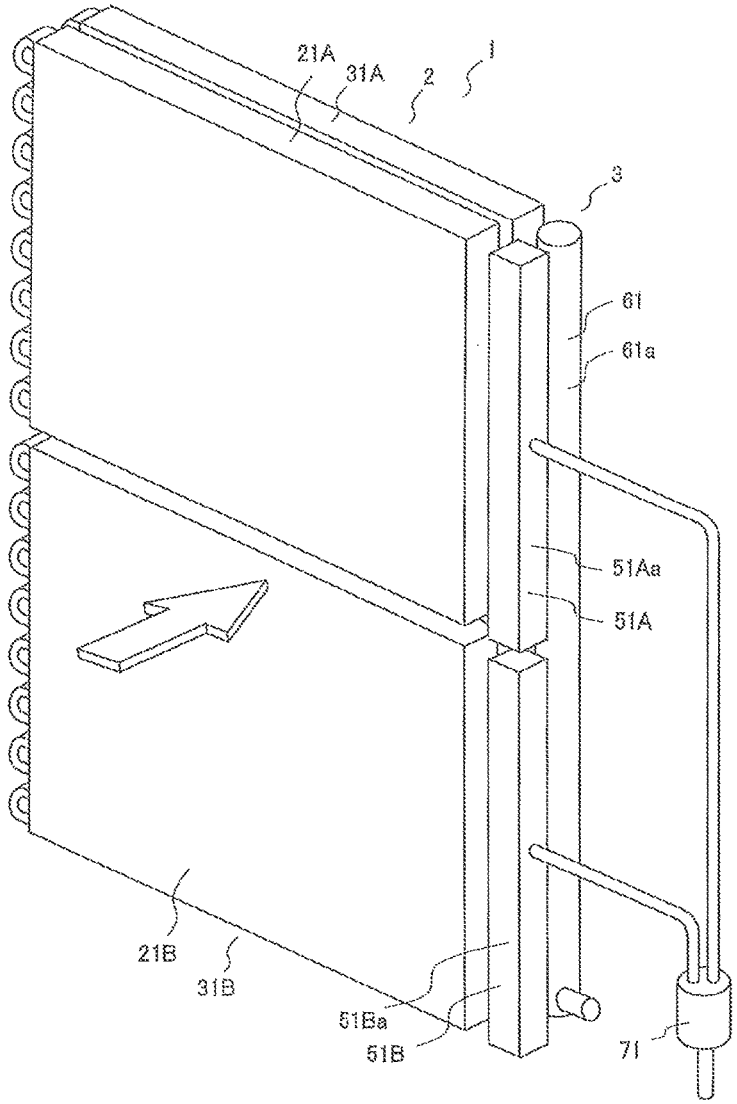
FIG. 19 is a perspective view of a heat exchanger according to Embodiment 3.

FIG. 19 is a perspective view of the heat exchanger according to Embodiment 3.

As illustrated in FIG. 19, the heat exchanging unit 2 includes a windward upper-stage heat exchanging unit 21A and a leeward upper-stage heat exchanging unit 31A arranged on the upper side in the gravity direction, and a windward lower-stage heat exchanging unit 21B and a leeward lower-stage heat exchanging unit 31B arranged on the lower side in the gravity direction. The windward upper-stage heat exchanging unit 21A and the leeward upper-stage heat exchanging unit 31A may be juxtaposed to the windward lower-stage heat exchanging unit 21B and the leeward lower-stage heat exchanging unit 31B in, for example, a direction perpendicular to the gravity direction.

An upper stacking type header 51A is connected to the windward upper-stage heat exchanging unit 21A, and a distributing and joining flow passage 51Aa is formed inside the upper stacking type header 51A. A lower stacking type header 51B is connected to the windward lower-stage heat exchanging unit 21B, and a distributing and joining flow passage 51Ba is formed inside the lower stacking type header 51B. Each of the upper stacking type header 51A and the lower stacking type header 51B is connected to a distributor 71 including capillary tubes partially arranged in flow passages. When the heat exchanging unit 2 acts as an evaporator, the distributor 71 distributes refrigerant flowing in from the refrigerant pipe to the upper stacking type header 51A and the lower stacking type header 51B. When the heat exchanging unit 2 acts as a condenser, the distributor 71 joins flows of refrigerant flowing in from the upper stacking type header 51A and the lower stacking type header 51B to flow out to the refrigerant pipe. The heat exchanging unit 2 may be divided even more finely, and the distributor 71 may distribute the refrigerant to three or more flow passages.

That is, when the heat exchanging unit 2 acts as an evaporator, the heat exchanger 1 separately includes the upper stacking type header 51A and the lower stacking type header 51B each including the distributing flow passage (distributing and joining flow passage 51Aa and distributing and joining flow passage 51Ba) formed therein and excluding the joining flow passage (distributing and joining flow passage 61*a*), and the tubular header 61 including the joining flow passage (distributing and joining flow passage 61*a*) formed therein and excluding the distributing flow passage (distributing and joining flow passage 51Aa and distributing and joining flow passage 51Ba). In such a case, the upper stacking type header 51A and the lower stacking type header 51B each correspond to the "first header" of the present invention, whereas the tubular header 61 corresponds to the "second header" of the present invention.

Further, when the heat exchanging unit 2 acts as a condenser, the heat exchanger 1 separately includes the tubular header 61 including the distributing flow passage (distributing and joining flow passage 61*a*) formed therein and excluding the joining flow passage (distributing and joining flow passage 51Aa and distributing and joining flow passage 51Ba), and the upper stacking type header 51A and the lower stacking type header 51B each including the joining flow passage (distributing and joining flow passage 51Aa and distributing and joining flow passage 51Ba) formed therein and excluding the distributing flow passage (distributing and joining flow passage 61*a*). In such a case, the tubular header 61 corresponds to the "first header" of the present invention, whereas the upper stacking type header 51A and the lower stacking type header 51B each correspond to the "second header" of the present invention.

<Operations of Heat Exchanger and Air-conditioning Apparatus>

The operations of the heat exchanger according to Embodiment 3 and the air-conditioning apparatus to which the heat exchanger is applied are described below.

(Operations of Heat Exchanger and Air-Conditioning Apparatus During Heating Operation)

Figure 20:
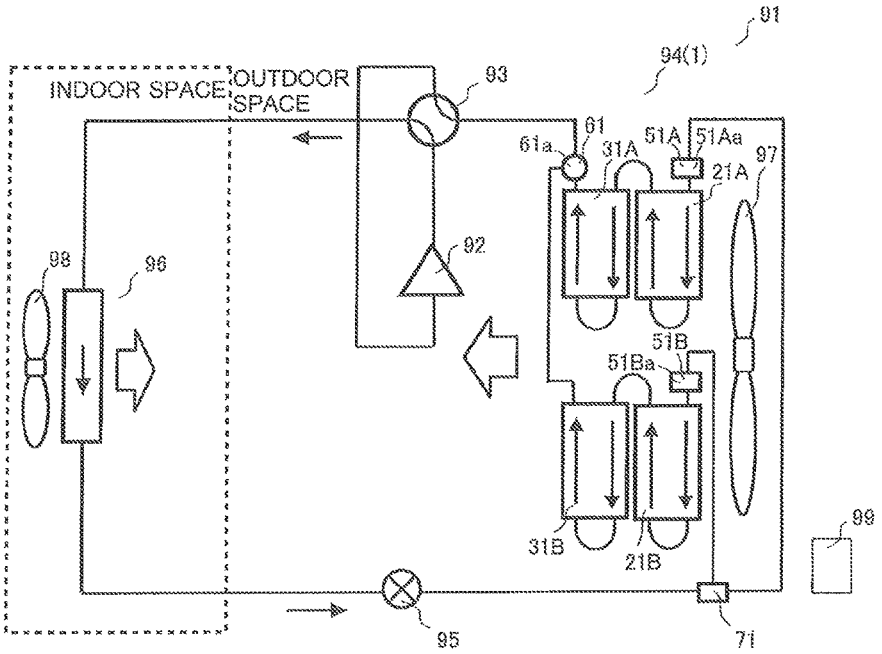
FIG. 20 is a diagram for illustrating a configuration of an air-conditioning apparatus to which the heat exchanger according to Embodiment 3 is applied.

FIG. 20 is a diagram for illustrating the configuration of the air-conditioning apparatus to which the heat exchanger according to Embodiment 3 is applied. Note that, FIG. 20 is an illustration of a case where the air-conditioning apparatus 91 performs the heating operation.

With reference to FIG. 20, the flow of the refrigerant during the heating operation is described below.

In the outdoor heat exchanger 94, the refrigerant is distributed by the distributor 71 to flow into the distributing and joining flow passage 51Aa and the distributing and joining flow passage 51Ba of the upper stacking type header 51A and the lower stacking type header 51B. Then, the refrigerant is further distributed to flow into the windward upper-stage heat exchanging unit 21A and the windward lower-stage heat exchanging unit 21B. The refrigerant passing through the windward upper-stage heat exchanging unit 21A and the windward lower-stage heat exchanging unit 21B passes through the leeward upper-stage heat exchanging unit 31A and the leeward lower-stage heat exchanging unit 31B to flow into the distributing and joining flow passage 61*a* of the tubular header 61 so that the flows of the refrigerant are joined to each other.

(Operations of Heat Exchanger and Air-Conditioning Apparatus During Cooling Operation)

Figure 21:
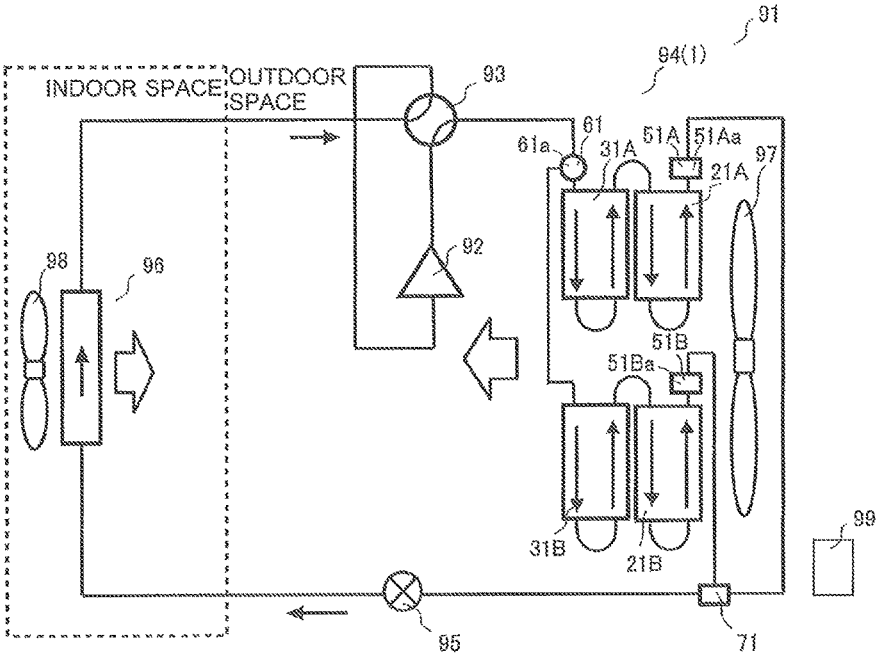
FIG. 21 is a diagram for illustrating the configuration of the air-conditioning apparatus to which the heat exchanger according to Embodiment 3 is applied.

FIG. 21 is a diagram for illustrating the configuration of the air-conditioning apparatus to which the heat exchanger according to Embodiment 3 is applied. Note that, FIG. 21 is an illustration of the case where the air-conditioning apparatus 91 performs the cooling operation.

With reference to FIG. 21, the flow of the refrigerant during the cooling operation is described below.

In the outdoor heat exchanger 94, the refrigerant flows into the distributing and joining flow passage 61*a* of the tubular header 61 so that the refrigerant is distributed to flow into the leeward upper-stage heat exchanging unit 31A and the leeward lower-stage heat exchanging unit 31B. The refrigerant passing through the leeward upper-stage heat exchanging unit 31A and the leeward lower-stage heat exchanging unit 31B passes through the windward upper-stage heat exchanging unit 21A and the windward lower-stage heat exchanging unit 21B to flow into the distributing and joining flow passage 51Aa and the distributing and joining flow passage 51Ba of the upper stacking type header 51A and the lower stacking type header 51B so that the flows of the refrigerant are joined to each other. Then, the flows of the refrigerant are further joined to each other by the distributor 71.

<Actions of Heat Exchanger>

Actions of the heat exchanger according to Embodiment 3 are described below.

Also in the heat exchanger 1 according to Embodiment 3, the refrigerant temperature is changed similarly to the heat exchanger 1 according to Embodiment 1, that is, similarly to FIG. 11 and FIG. 12. In other words, also in the heat exchanger 1 according to Embodiment 3, similar actions to those of the heat exchanger 1 according to Embodiment 1 are attained.

Further, the heat exchanger 1 includes the upper stacking type header 51A and the lower stacking type header 51B, which are connected to the distributor 71. The distributor 71 is capable of uniformly distributing the refrigerant, but has a small surface area. Thus, in a case where the distributing and joining unit 3 is constructed of only the distributor 71, the refrigerant passing through the distributing and joining unit 3 cannot be heated when the heat exchanger 1 acts as an evaporator, whereas the refrigerant passing through the distributing and joining unit 3 cannot be cooled when the heat exchanger 1 acts as a condenser. Further, in a case where the distributing and joining unit 3 is constructed of a single stacking type header 51 as in the heat exchanger 1 according to Embodiment 1, the heat exchanging unit 2 cannot be divided in the manufacture, with the result that the manufacture becomes difficult and the manufacturing facility is upsized. In contrast, in a case where the heat exchanger 1 includes the upper stacking type header 51A and the lower stacking type header 51B, which are connected to the distributor 71, the surface area is secured to enhance the heat exchange efficiency, and the refrigerant can be uniformly distributed when the heat exchanger 1 acts as an evaporator. Further, the situations where the manufacture becomes difficult and the manufacturing facility is upsized are controlled. Still further, the heat exchanger 1 can be upsized by increasing the numbers of the stacking type headers, and thus the components are shared.

In addition, the heat exchanger 1 includes a single tubular header 61. Thus, for example, the component cost and the number of assembling steps are reduced. Note that, the tubular header 61 allows refrigerant in a gas state to be distributed when the heat exchanger 1 acts as a condenser. Thus, the uniformity in distribution of the refrigerant is secured even when the tubular header 61 is divided and divided portions are not connected to the distributor.

Embodiment 4

A heat exchanger according to Embodiment 4 is described.

Note that, overlapping description or similar description to that of each of Embodiment 1 to Embodiment 3 is appropriately simplified or omitted. Further, in the following, there is described a case where two rows of the heat exchanging units 2 of the heat exchanger 1 are constructed as in the heat exchanger 1 according to Embodiment 1, but the heat exchanging unit 2 of the heat exchanger 1 may be constructed of a single row of the heat exchanging unit as in the heat exchanger 1 according to Embodiment 2. Still further, there is described a case where the heat exchanging unit 2 of the heat exchanger 1 is divided as in the heat exchanger 1 according to Embodiment 3, but the heat exchanging unit 2 of the heat exchanger 1 is not limited to be divided as in the heat exchanger 1 according to each of Embodiments 1 and 2.

<Configuration of Heat Exchanger>

The configuration of the heat exchanger according to Embodiment 4 is described below.

(Schematic Configuration of Heat Exchanger)

The schematic configuration of the heat exchanger according to Embodiment 4 is described below.

Figure 22:
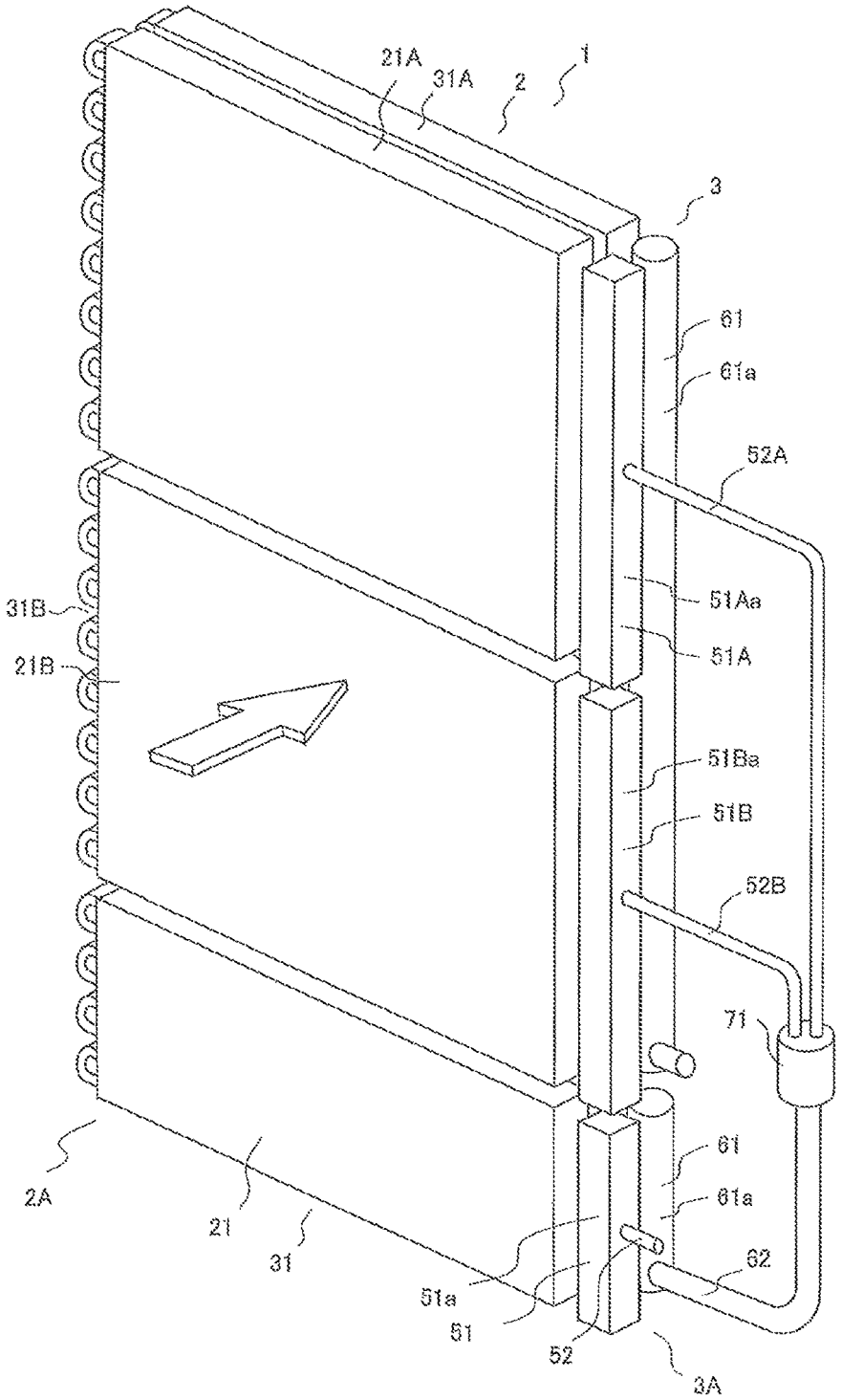
FIG. 22 is a perspective view of a heat exchanger according to Embodiment 4.

FIG. 22 is a perspective view of the heat exchanger according to Embodiment 4.

As illustrated in FIG. 22, the heat exchanger 1 includes the heat exchanging unit 2, a lower-stage heat exchanging unit 2A arranged below the heat exchanging unit 2 in the gravity direction, the distributing and joining unit 3, and a lower-stage distributing and joining unit 3A arranged below the distributing and joining unit 3 in the gravity direction. The lower-stage heat exchanging unit 2A has a similar configuration to that of the heat exchanging unit 2. The lower-stage distributing and joining unit 3A has a similar configuration to that of the distributing and joining unit 3. The lower-stage heat exchanging unit 2A and the lower-stage distributing and joining unit 3A have shorter dimensions in the height direction than the heat exchanging unit 2 and the distributing and joining unit 3, respectively. The heat exchanging unit 2 corresponds to an "upper-stage heat exchanging unit" of the present invention. The lower-stage heat exchanging unit 2A corresponds to the "heat exchanging unit" of the present invention.

The connection pipe 52 of the stacking type header 51 of the lower-stage distributing and joining unit 3A is connected to the refrigerant pipe (not shown). The connection pipe 62 of the tubular header 61 of the lower-stage distributing and joining unit 3A is connected to the distributor 71.

That is, when the heat exchanging unit 2 acts as an evaporator, the lower-stage distributing and joining unit 3A of the heat exchanger 1 separately includes the stacking type header 51 including the distributing flow passage (distributing and joining flow passage 51*a*) formed therein and excluding the joining flow passage (distributing and joining flow passage 61*a*), and the tubular header 61 including the joining flow passage (distributing and joining flow passage 61*a*) formed therein and excluding the distributing flow passage (distributing and joining flow passage 51*a*). In such a case, the stacking type header 51 corresponds to the "first header" of the present invention, whereas the tubular header 61 corresponds to the "second header" of the present invention.

Further, when the heat exchanging unit 2 acts as a condenser, the lower-stage distributing and joining unit 3A of the heat exchanger 1 separately includes the tubular header 61 including the distributing flow passage (distributing and joining flow passage 61*a*) formed therein and excluding the joining flow passage (distributing and joining flow passage 51*a*), and the stacking type header 51 including the joining flow passage (distributing and joining flow passage 51*a*) formed therein and excluding the distributing flow passage (distributing and joining flow passage 61*a*). In such a case, the tubular header 61 corresponds to the "first header" of the present invention, whereas the stacking type header 51 corresponds to the "second header" of the present invention.

<Operations of Heat Exchanger and Air-Conditioning Apparatus>

The operations of the heat exchanger according to Embodiment 4 and the air-conditioning apparatus to which the heat exchanger is applied are described below.

(Operations of Heat Exchanger and Air-Conditioning Apparatus During Heating Operation)

Figure 23:
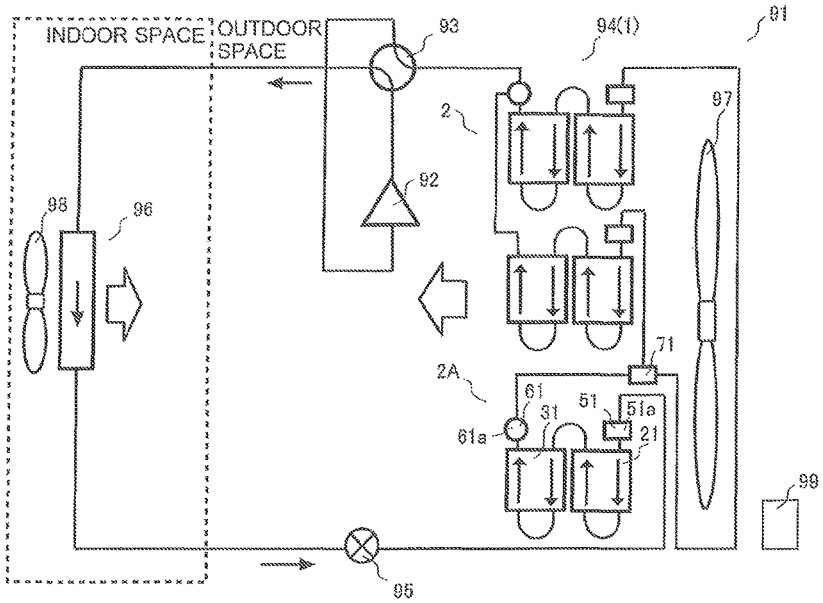
FIG. 23 is a diagram for illustrating a configuration of an air-conditioning apparatus to which the heat exchanger according to Embodiment 4 is applied.

FIG. 23 is a diagram for illustrating the configuration of the air-conditioning apparatus to which the heat exchanger according to Embodiment 4 is applied. Note that, FIG. 23 is an illustration of a case where the air-conditioning apparatus 91 performs the heating operation.

With reference to FIG. 23, the flow of the refrigerant during the heating operation is described below.

In the outdoor heat exchanger 94, the refrigerant flows into the distributing and joining flow passage 51*a* of the stacking type header 51 of the lower-stage distributing and joining unit 3A at a higher temperature than that of the air supplied to the heat exchanger 1 along with the drive of the outdoor fan 97 so that the refrigerant is distributed to flow into the windward heat exchanging unit 21 of the lower-stage heat exchanging unit 2A. The refrigerant flowing into the windward heat exchanging unit 21 of the lower-stage heat exchanging unit 2A passes through the leeward heat exchanging unit 31 of the lower-stage heat exchanging unit 2A to flow into the distributing and joining flow passage 61*a* of the tubular header 61 of the lower-stage distributing and joining unit 3A so that the flows of the refrigerant are joined to each other. The joined refrigerant flows into the distributor 71 so that the refrigerant is distributed to connection pipes 52A and 52B of the heat exchanging unit 2.

(Operations of Heat Exchanger and Air-Conditioning Apparatus During Cooling Operation)

Figure 24:
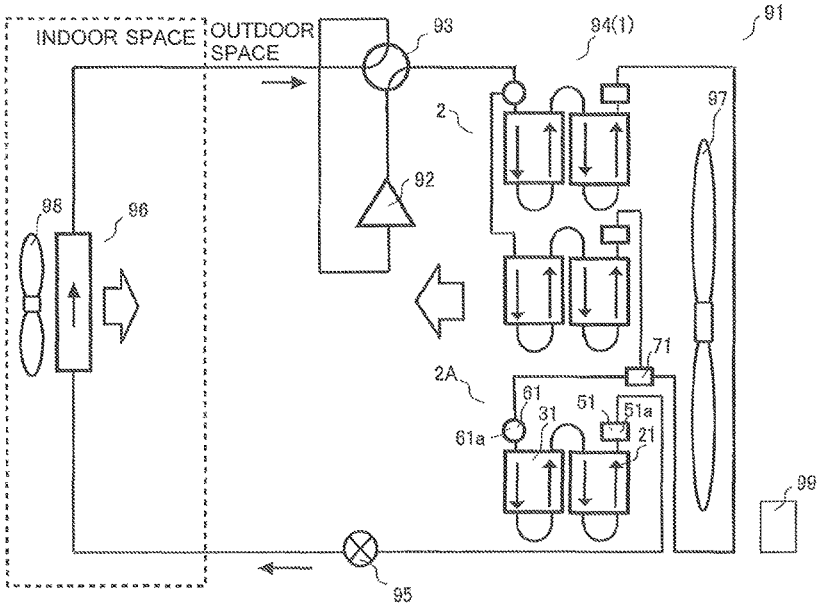
FIG. 24 is a diagram for illustrating the configuration of the air-conditioning apparatus to which the heat exchanger according to Embodiment 4 is applied.

FIG. 24 is a diagram for illustrating the configuration of the air-conditioning apparatus to which the heat exchanger according to Embodiment 4 is applied. Note that, FIG. 24 is an illustration of the case where the air-conditioning apparatus 91 performs the cooling operation.

With reference to FIG. 24, the flow of the refrigerant during the cooling operation is described below.

In the outdoor heat exchanger 94, the refrigerant passes through the connection pipes 52A and 52B of the heat exchanging unit 2 to flow into the distributor 71 so that the flows of the refrigerant are joined to each other. The joined refrigerant flows into the distributing and joining flow passage 61*a* of the tubular header 61 of the lower-stage distributing and joining unit 3A so that the refrigerant is distributed to flow into the leeward heat exchanging unit 31 of the lower-stage heat exchanging unit 2A. The refrigerant flowing into the leeward heat exchanging unit 31 of the lower-stage heat exchanging unit 2A passes through the windward heat exchanging unit 21 of the lower-stage heat exchanging unit 2A to flow into the distributing and joining flow passage 51*a* of the stacking type header 51 of the lower-stage distributing and joining unit 3A so that the flows of the refrigerant are joined to each other. The joined refrigerant flows out to the refrigerant pipe.

<Actions of Heat Exchanger>

Actions of the heat exchanger according to Embodiment 4 are described below.

Figure 25:
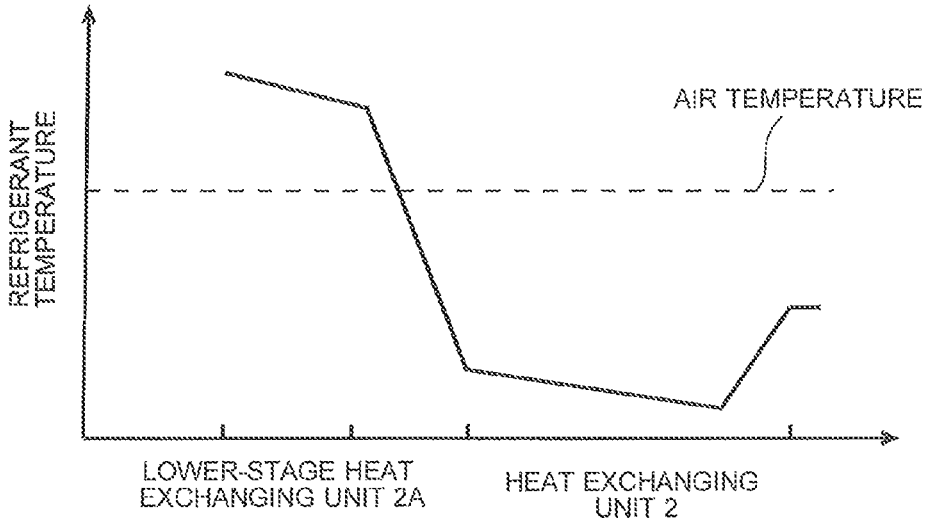
FIG. 25 is a graph for showing an overview of refrigerant temperature change in a case where a heat exchanging unit of the heat exchanger according to Embodiment 4 acts as an evaporator.

FIG. 25 is a graph for showing an overview of refrigerant temperature change in the case where the heat exchanging unit of the heat exchanger according to Embodiment 4 acts as an evaporator.

As illustrated in FIG. 25, when the heat exchanging unit 2 acts as an evaporator, the refrigerant flowing into the lower-stage heat exchanging unit 2A at a higher temperature than that of the air supplied to the heat exchanger 1 along with the drive of the outdoor fan 97 heats the windward heat transfer tube 22 and the leeward heat transfer tube 32 of the lower-stage heat exchanging unit 2A, and hence the refrigerant temperature is decreased. The temperature of the refrigerant flowing out of the lower-stage heat exchanging unit 2A is further decreased due to the pressure drop caused while the refrigerant passes through the connection pipe 62, the distributor 71, and the connection pipes 52A and 52B. This temperature is lower than that of the air supplied to the heat exchanger 1. When the refrigerant flowing into the heat exchanging unit 2 is heated by the air and thus completely evaporated, the refrigerant is brought into a superheated gas state, and hence the refrigerant temperature is increased.

Thus, dew condensation on the windward fins 23 and the leeward fins 33 of the lower-stage heat exchanging unit 2A or other portions is controlled. Further, in particular, when the temperature of the air supplied to the heat exchanger 1 along with the drive of the outdoor fan 97 is 0 degrees Celsius or less, a situation where frost adheres to be deposited on the windward fins 23 and the leeward fins 33 of the lower-stage heat exchanging unit 2A or other portions is controlled. Still further, during a defrosting operation for melting the frost adhering to the heat exchanging unit 2, a situation where water of the melting frost accumulated on the windward fins 23 and the leeward fins 33 of the lower-stage heat exchanging unit 2A or other portions freezes again to be deposited is controlled. That is, in the heat exchanger 1, the stability of the quality of the refrigeration cycle is enhanced.

Further, in the lower-stage heat exchanging unit 2A of the heat exchanger 1, the distributing flow passage and the joining flow passage are formed in separate headers. Thus, the refrigerant flowing into the distributing flow passage does not exchange heat with the refrigerant having heated the windward heat transfer tube 22 and the leeward heat transfer tube 32 of the lower-stage heat exchanging unit 2A and passing through the joining flow passage, thereby controlling the decrease in temperature of the refrigerant yet to be heated. As a result, the efficiency to enhance the above-mentioned stability of the quality of the refrigeration cycle is enhanced.

The present invention has been described above with reference to Embodiment 1 to Embodiment 4, but the present invention is not limited to those embodiments. For example, a part or all of the respective embodiments may be combined.

The invention claimed is:

1. A heat exchanger, comprising:

at least one heat exchanging unit including a plurality of stages of refrigerant flow passages each allowing refrigerant to flow in from an end portion on one side of each of the refrigerant flow passages, turn back at a first turn-back portion, and flow out of an end portion on an other side juxtaposed to the end portion on the one side; and a distributing and joining unit connected to the at least one heat exchanging unit, the distributing and joining unit including a distributing flow passage allowing the refrigerant to be distributed and flow into a plurality of the end portions on the one side, and a joining flow passage allowing the refrigerant to be joined and flow out of a plurality of the end portions on the other side, the distributing and joining unit separately including a first header including the distributing flow passage formed therein and excluding the joining flow passage, and a second header juxtaposed to the first header, the second header including the joining flow passage formed therein and excluding the distributing flow passage, the first header and the second header being juxtaposed to an one end of the at least one heat exchanging unit, any one header of the first header and the second header including a stacking type header including a plurality of plate-like members including partial flow passages formed therein and stacked to each other so that the partial flow passages are communicated with each other to form the distributing flow passage or the joining flow passage, the stacking type header being arranged on a windward side with respect to an other header of the first header and the second header along a passing direction of a fluid supplied to the at least one heat exchanging unit.

2. The heat exchanger of claim 1, wherein, when the at least one heat exchanging unit acts as an evaporator, the first header is the stacking type header.

3. The heat exchanger of claim 2, wherein, when the at least one heat exchanging unit acts as an evaporator, the first header is arranged on the windward side with respect to the second header.

4. The heat exchanger of claim 2, wherein, when the at least one heat exchanging unit acts as an evaporator, the distributing flow passage includes a structure branching from one flow passage into two flow passages, the structure being multiply provided.

5. The heat exchanger of claim 1, wherein, when the at least one heat exchanging unit acts as a condenser, the second header is the stacking type header.

6. The heat exchanger of claim 5, wherein, when the at least one heat exchanging unit acts as a condenser, the second header is arranged on the windward side with respect to the first header.

7. The heat exchanger of claim 5, wherein, when the at least one heat exchanging unit acts as a condenser, the joining flow passage includes a structure to join two flow passages into one flow passage, the structure being multiply provided.

8. The heat exchanger of claim 1, wherein the first header and the second header are juxtaposed along a passing direction of the fluid exchanging heat with the refrigerant in the at least one heat exchanging unit.

9. The heat exchanger of claim 1, wherein the refrigerant flow passages each allowing the refrigerant turning back at the first turn-back portion to turn back at a second turn-back portion, turn back at a third turn-back portion, and flow out from the end portion on the other side.

10. The heat exchanger of claim 1, wherein the at least one heat exchanging unit comprises a plurality of heat exchanging units, wherein the stacking type header is provided to each of the plurality of heat exchanging units, and wherein a plurality of the stacking type headers are connected to a distributor including capillary tubes partially arranged in flow passages.

11. The heat exchanger of claim 1, further comprising an other heat exchanging unit arranged above the at least one heat exchanging unit in a gravity direction, wherein, when the other heat exchanging unit acts as an evaporator, a temperature of the refrigerant flowing out of the first header is higher than a temperature of the fluid exchanging heat with the refrigerant in the at least one heat exchanging unit, and wherein the refrigerant flowing out of the second header flows into the other heat exchanging unit.

12. An air-conditioning apparatus, comprising the heat exchanger of claim 1.

* * * * *